US009487352B2

(12) United States Patent
Fenton

(10) Patent No.: US 9,487,352 B2
(45) Date of Patent: Nov. 8, 2016

(54) CONTAINER WITH SUPPORTS

(71) Applicant: STI Holdings, Inc., Stoughton, WI (US)

(72) Inventor: Gary L. Fenton, Edgerton, WI (US)

(73) Assignee: STI Holdings, Inc., Stoughton, WI (US)

( * ) Notice: Subject to any disclaimer, the term of this patent is extended or adjusted under 35 U.S.C. 154(b) by 336 days.

(21) Appl. No.: 14/081,230

(22) Filed: Nov. 15, 2013

(65) Prior Publication Data

US 2014/0069912 A1 Mar. 13, 2014

Related U.S. Application Data

(62) Division of application No. 11/514,431, filed on Sep. 1, 2006, now Pat. No. 9,067,729.

(60) Provisional application No. 60/713,877, filed on Sep. 2, 2005.

(51) Int. Cl.

| | |
|---|---|
| ***B65D 88/00*** | (2006.01) |
| ***B65D 90/08*** | (2006.01) |
| ***B65D 88/12*** | (2006.01) |

(Continued)

(52) U.S. Cl.

CPC ..... *B65D 90/08* (2013.01); *B65D 88/12* (2013.01); *B65D 88/121* (2013.01); *B65D 90/00* (2013.01); *B65D 90/0026* (2013.01); *B65D 90/02* (2013.01)

(58) Field of Classification Search

CPC .... B65D 88/121; B65D 88/12; B65D 90/00; B65D 90/0026; B65D 90/02; B65D 90/08

USPC ..... 220/1.5

See application file for complete search history.

(56) References Cited

U.S. PATENT DOCUMENTS

| | | | |
|---|---|---|---|
| 274,322 | A | 3/1883 | Hayes |
| 384,326 | A | 6/1888 | Mallett |
| 980,553 | A | 1/1911 | Osterholm |

(Continued)

FOREIGN PATENT DOCUMENTS

| | | |
|---|---|---|
| CA | 2252249 | 7/2006 |
| CA | 2325249 | 8/2007 |

(Continued)

OTHER PUBLICATIONS

Office Action from the United States Patent and Trademark Office for U.S. Appl. No. 14/171,021 dated Feb. 25, 2015 (41 pages).

(Continued)

*Primary Examiner* — Anthony Stashick
*Assistant Examiner* — James M Van Buskirk
(74) *Attorney, Agent, or Firm* — Michael Best & Friedrich LLP

(57) ABSTRACT

A container is provided with a frame including one or more support structures each having a stacking post with a thin cross-sectional shape. Multiple support structures having such stacking posts can be provided along the length of the container to enable the container to be used in a stacked configuration. The container can provide an expanded interior loadable width for increased loading flexibility and capacity, and can have recessed upper and lower handling fitting joints in order to provide stronger and space-saving connections between a header and an upper handling fitting, between the upper handling fitting and a stacking post, between the stacking post and a lower handling fitting, and/or between the lower handling fitting and a floor component.

13 Claims, 14 Drawing Sheets

(51) Int. Cl.

| | |
|---|---|
| ***B65D 90/00*** | (2006.01) |
| ***B65D 90/02*** | (2006.01) |

(56) References Cited

U.S. PATENT DOCUMENTS

| | | | |
|---|---|---|---|
| 1,193,657 | A | 8/1916 | Zeek |
| 1,688,437 | A | 10/1928 | Romine |
| 1,744,824 | A | 1/1930 | Callison |
| 1,867,433 | A | 7/1932 | Young |
| 2,003,287 | A | 6/1935 | Fitch |
| 2,098,053 | A | 11/1937 | Mack |
| 2,140,158 | A | 12/1938 | Knapp |
| 2,446,323 | A | 8/1948 | Davis et al. |
| 2,478,993 | A | 8/1949 | Wing |
| 2,513,829 | A | 7/1950 | Vaughn |
| 2,650,185 | A | 8/1953 | Larson et al. |
| 2,871,056 | A | 1/1959 | Levittt |
| 2,883,233 | A | 4/1959 | Beckley |
| 2,901,283 | A | 8/1959 | Curell |
| 2,914,147 | A | 11/1959 | Millard |
| 2,934,372 | A | 4/1960 | Jewell et al. |
| 2,956,517 | A | 10/1960 | Chapman et al. |
| 2,962,323 | A | 11/1960 | McBride |
| 2,991,116 | A | 7/1961 | Andrews |
| 3,003,810 | A | 10/1961 | Kloote et al. |
| 3,010,547 | A | 11/1961 | Foster |
| 3,044,656 | A | 7/1962 | Combs et al. |
| 3,085,707 | A | 4/1963 | Tantlinger |
| 3,128,897 | A | 4/1964 | Wilkins |
| 3,229,441 | A | 1/1966 | Heffner |
| 3,242,625 | A | 3/1966 | Tillinghast |
| 3,266,837 | A | 8/1966 | Stricker, Jr. et al. |
| 3,276,832 | A | 10/1966 | Reilly |
| 3,294,419 | A | 12/1966 | Martin et al. |
| 3,310,925 | A | 3/1967 | Brun |
| 3,316,041 | A | 4/1967 | Nelson |
| 3,334,007 | A | 8/1967 | Flagan |
| 3,386,218 | A | 6/1968 | Scott |
| 3,386,600 | A | 6/1968 | Betjemann |
| 3,393,920 | A | 7/1968 | Ehrlich |
| 3,401,814 | A | 9/1968 | Chiswell et al. |
| 3,407,547 | A | 10/1968 | Doke et al. |
| 3,429,083 | A | 2/1969 | Voros |
| 3,432,979 | A | 3/1969 | Heimann |
| 3,450,830 | A | 6/1969 | Kyte |
| 3,456,829 | A | 7/1969 | Glassmeyer |
| 3,480,174 | A | 11/1969 | Sherwood |
| 3,529,741 | A | 9/1970 | Walker et al. |
| 3,561,633 | A | 2/1971 | Morrison et al. |
| 3,568,607 | A | 3/1971 | Gutridge |
| 3,591,033 | A | 7/1971 | Partridge |
| 3,633,954 | A | 1/1972 | Tantlinger |
| 3,691,595 | A | 9/1972 | Backteman et al. |
| 3,734,308 | A | 5/1973 | Pasternack |
| 3,735,713 | A | 5/1973 | Glassmeyer |
| 3,749,438 | A | 7/1973 | Loomis et al. |
| 3,776,169 | A | 12/1973 | Strecker |
| 3,783,563 | A | 1/1974 | Moore |
| 3,796,457 | A | 3/1974 | Hinchliff |
| 3,801,177 | A | 4/1974 | Fylling et al. |
| 3,807,581 | A | 4/1974 | Nichols |
| 3,815,500 | A | 6/1974 | Glassmeyer |
| 3,815,517 | A | 6/1974 | Przybylinski |
| 3,830,381 | A | 8/1974 | Bodenheimer et al. |
| 3,834,575 | A | 9/1974 | Carr |
| 3,842,755 | A | 10/1974 | Carr |
| 3,842,756 | A | 10/1974 | Marulic |
| 3,854,620 | A | 12/1974 | Saidla |
| 3,868,042 | A | 2/1975 | Bodenheimer |
| 3,904,524 | A | 9/1975 | Pelton et al. |
| 3,907,148 | A | 9/1975 | Meller et al. |
| 3,932,976 | A | 1/1976 | Steel |
| 3,955,702 | A | 5/1976 | Lundy |
| 4,000,406 | A | 12/1976 | Bhavsar |
| 4,003,492 | A | 1/1977 | Beveridge et al. |
| 4,018,480 | A | 4/1977 | Stone |
| 4,026,596 | A | 5/1977 | Carr |
| 4,037,379 | A | 7/1977 | Ozanne |
| 4,045,927 | A | 9/1977 | Diaz |
| 4,061,813 | A | 12/1977 | Geimer et al. |
| 4,065,168 | A | 12/1977 | Gregg |
| 4,078,348 | A | 3/1978 | Rothman |
| 4,090,903 | A | 5/1978 | Matsui |
| 4,104,840 | A | 8/1978 | Heintz et al. |
| 4,106,252 | A | 8/1978 | Rutten |
| 4,136,465 | A | 1/1979 | Wilson |
| 4,144,984 | A | 3/1979 | Saunders |
| 4,151,925 | A | 5/1979 | Glassmeyer |
| 4,212,405 | A | 7/1980 | Schmidt |
| 4,214,789 | A | 7/1980 | Katz et al. |
| 4,258,520 | A | 3/1981 | Rehbein |
| 4,262,961 | A | 4/1981 | Schmidt |
| 4,266,820 | A | 5/1981 | Whaley et al. |
| 4,271,975 | A | 6/1981 | Ketner et al. |
| 4,277,212 | A | 7/1981 | Rosaia |
| 4,288,136 | A | 9/1981 | Le Mer |
| 4,303,169 | A | 12/1981 | Grey |
| 4,325,488 | A | 4/1982 | Ketner |
| 4,333,280 | A | 6/1982 | Morton |
| 4,357,047 | A | 11/1982 | Katz |
| 4,360,115 | A | 11/1982 | Saunders |
| 4,366,603 | A | 1/1983 | Hulse |
| 4,366,905 | A | 1/1983 | Forshee |
| 4,388,032 | A | 6/1983 | Stohler et al. |
| 4,416,384 | A | 11/1983 | Bjurling |
| 4,420,183 | A | 12/1983 | Sherman |
| 4,422,558 | A | 12/1983 | Mittelman et al. |
| 4,428,491 | A | 1/1984 | Mittelmann et al. |
| 4,431,368 | A | 2/1984 | Katz et al. |
| 4,433,522 | A | 2/1984 | Yerushalmi |
| 4,437,699 | A | 3/1984 | Lewis et al. |
| 4,444,818 | A | 4/1984 | Tominaga et al. |
| 4,455,807 | A | 6/1984 | Ehrlich |
| 4,470,231 | A | 9/1984 | Lewis |
| 4,498,264 | A | 2/1985 | McCafferty et al. |
| 4,505,402 | A | 3/1985 | Gerhard |
| 4,506,798 | A | 3/1985 | Goutille |
| 4,558,797 | A | 12/1985 | Mitchell |
| 4,576,017 | A | 3/1986 | Combs et al. |
| 4,576,300 | A | 3/1986 | Kedzior |
| 4,585,683 | A | 4/1986 | Curnow |
| 4,589,565 | A | 5/1986 | Spivey |
| 4,593,831 | A | 6/1986 | Clive-Smith |
| 4,614,278 | A | 9/1986 | Gerhard |
| 4,626,155 | A | 12/1986 | Hlinsky et al. |
| 4,648,764 | A | 3/1987 | Pavlick |
| 4,656,809 | A | 4/1987 | Wilson |
| 4,685,721 | A | 8/1987 | Banerjea |
| 4,703,948 | A | 11/1987 | Ehrlich |
| 4,729,570 | A | 3/1988 | Welch, Jr. |
| 4,730,428 | A | 3/1988 | Head et al. |
| 4,759,294 | A | 7/1988 | Schuller et al. |
| 4,769,188 | A | 9/1988 | Graham et al. |
| 4,782,637 | A | 11/1988 | Eriksson et al. |
| 4,784,548 | A | 11/1988 | Butcher et al. |
| 4,793,519 | A | 12/1988 | Voorhies, Jr. |
| 4,795,049 | A | 1/1989 | Alcorn |
| 4,810,027 | A | 3/1989 | Ehrlich |
| 4,836,411 | A | 6/1989 | Jones |
| 4,837,999 | A | 6/1989 | Stayner |
| 4,844,672 | A | 7/1989 | Yurgevich |
| 4,848,619 | A | 7/1989 | Corompt |
| 4,860,911 | A | 8/1989 | Jones, Sr. |
| 4,862,810 | A | 9/1989 | Jamrozy et al. |
| 4,872,574 | A | 10/1989 | Lam |
| 4,881,859 | A | 11/1989 | Ehrlich |
| 4,893,567 | A | 1/1990 | Hill et al. |
| 4,904,017 | A | 2/1990 | Ehrlich |
| 4,905,822 | A | 3/1990 | Bosco |
| 4,905,854 | A | 3/1990 | Gerhard |
| 4,930,426 | A | 6/1990 | Saxton et al. |
| 4,930,661 | A | 6/1990 | Voorhies |
| 4,940,279 | A | 7/1990 | Abott et al. |
| 4,944,421 | A | 7/1990 | Yurgevich |

(56) References Cited

U.S. PATENT DOCUMENTS

| | | | |
|---|---|---|---|
| 4,958,472 | A | 9/1990 | Ehrlich |
| 4,984,406 | A | 1/1991 | Friesen |
| 4,986,705 | A | 1/1991 | Durkin |
| 4,998,636 | A | 3/1991 | Hardigg |
| 5,020,948 | A | 6/1991 | Ihara |
| 5,042,395 | A | 8/1991 | Wackerle et al. |
| 5,052,579 | A | 10/1991 | Boots |
| 5,054,403 | A | 10/1991 | Hill et al. |
| 5,058,756 | A | 10/1991 | Green |
| 5,066,066 | A | 11/1991 | Yurgevich et al. |
| 5,072,845 | A | 12/1991 | Grogan |
| 5,111,950 | A | 5/1992 | Wylenzek |
| 5,112,099 | A | 5/1992 | Yurgevich et al. |
| 5,140,913 | A | 8/1992 | Takeichi et al. |
| 5,154,302 | A | 10/1992 | Alcorn |
| 5,176,388 | A | 1/1993 | Horton |
| 5,178,292 | A | 1/1993 | Korzeniowski |
| 5,185,193 | A | 2/1993 | Phenicie et al. |
| 5,190,179 | A | 3/1993 | Richter et al. |
| 5,191,742 | A | 3/1993 | Romig et al. |
| 5,195,800 | A | 3/1993 | Stafford et al. |
| 5,205,428 | A | 4/1993 | Yurgevich et al. |
| 5,215,349 | A | 6/1993 | Horton |
| 5,222,621 | A | 6/1993 | Matias |
| 5,248,051 | A | 9/1993 | Yurgevich et al. |
| 5,255,806 | A | 10/1993 | Korzeniowski et al. |
| 5,265,748 | A | 11/1993 | Furukawa |
| 5,273,606 | A | 12/1993 | Greve et al. |
| 5,279,436 | A | 1/1994 | Elliott et al. |
| 5,282,663 | A | 2/1994 | Horton |
| 5,286,079 | A | 2/1994 | Zubko et al. |
| 5,299,405 | A | 4/1994 | Thompson |
| 5,332,274 | A | 7/1994 | Bauman |
| 5,348,175 | A | 9/1994 | Reynard |
| 5,348,176 | A | 9/1994 | Yurgevich et al. |
| 5,403,062 | A | 4/1995 | Sjostedt et al. |
| 5,403,063 | A | 4/1995 | Sjostedt et al. |
| 5,419,448 | A | 5/1995 | Watson |
| 5,426,893 | A | 6/1995 | Hoffman |
| 5,433,501 | A | 7/1995 | Thomas et al. |
| 5,439,266 | A | 8/1995 | Ehrlich |
| 5,449,081 | A | 9/1995 | Sjostedt et al. |
| 5,449,082 | A | 9/1995 | Reynard |
| 5,454,597 | A | 10/1995 | Thomas et al. |
| 5,462,188 | A | 10/1995 | Yurgevich |
| 5,492,747 | A | 2/1996 | Kemp et al. |
| 5,505,323 | A | 4/1996 | Naoki et al. |
| 5,507,405 | A | 4/1996 | Thomas et al. |
| 5,509,714 | A | 4/1996 | Schmidt |
| 5,526,622 | A | 6/1996 | Augustine |
| 5,562,981 | A | 10/1996 | Ehrlich |
| 5,573,293 | A | 11/1996 | Bauman et al. |
| 5,582,451 | A | 12/1996 | Baumann |
| 5,584,252 | A | 12/1996 | Smith et al. |
| 5,584,527 | A | 12/1996 | Sitter |
| 5,595,318 | A | 1/1997 | Barno |
| 5,607,200 | A | 3/1997 | Smidler |
| 5,660,427 | A | 8/1997 | Freeman et al. |
| 5,661,930 | A | 9/1997 | Porter |
| 5,678,715 | A | 10/1997 | Sjostedt et al. |
| 5,683,525 | A | 11/1997 | Kemp et al. |
| 5,688,086 | A | 11/1997 | Menzemer et al. |
| 5,700,118 | A | 12/1997 | Bennett et al. |
| 5,702,151 | A | 12/1997 | Grote et al. |
| 5,704,676 | A | 1/1998 | Hill |
| 5,741,042 | A | 4/1998 | Livingston et al. |
| 5,752,791 | A | 5/1998 | Ehrlich |
| 5,755,349 | A | 5/1998 | Brundle |
| 5,772,276 | A | 6/1998 | Fetz et al. |
| 5,774,972 | A | 7/1998 | Ehrlich |
| 5,782,519 | A | 7/1998 | Baumann |
| D398,264 | S | 9/1998 | Fetz et al. |
| 5,803,524 | A | 9/1998 | McCammon |
| 5,806,701 | A | 9/1998 | Bae |
| 5,816,423 | A | 10/1998 | Fenton et al. |
| 5,860,693 | A | 1/1999 | Ehrlich |
| 5,860,777 | A | 1/1999 | Walsh et al. |
| 5,876,089 | A | 3/1999 | Ehrlich |
| 5,884,794 | A | 3/1999 | Calhoun et al. |
| 5,934,742 | A | 8/1999 | Fenton et al. |
| 5,938,274 | A | 8/1999 | Ehrlich |
| 5,964,499 | A | 10/1999 | Carter |
| 5,992,117 | A | 11/1999 | Schmidt |
| 5,997,076 | A | 12/1999 | Ehrlich |
| 6,003,932 | A | 12/1999 | Banerjea et al. |
| 6,010,020 | A | 1/2000 | Abal |
| 6,106,205 | A | 8/2000 | Haire |
| 6,131,762 | A | 10/2000 | Metcalfe |
| 6,183,176 | B1 | 2/2001 | Weiner |
| 6,199,939 | B1 | 3/2001 | Ehrlich |
| 6,220,468 | B1 | 4/2001 | Lee |
| 6,220,651 | B1 | 4/2001 | Ehrlich |
| 6,237,794 | B1 * | 5/2001 | Fenton ..... B65D 88/121 220/1.5 |
| 6,338,513 | B1 * | 1/2002 | Williams ..... B65D 90/0033 220/1.5 |
| 6,349,988 | B1 | 2/2002 | Foster et al. |
| 6,412,854 | B2 | 7/2002 | Ehrlich |
| 6,425,626 | B1 | 7/2002 | Kloepfer |
| 6,450,564 | B1 | 9/2002 | Sill |
| 6,497,451 | B1 | 12/2002 | Jones et al. |
| 6,502,518 | B1 | 1/2003 | Miller |
| 6,527,335 | B1 | 3/2003 | Yurgevich |
| D472,704 | S | 4/2003 | Bruderer |
| 6,578,902 | B2 | 6/2003 | Sill |
| 6,626,622 | B2 | 9/2003 | Zubko |
| 6,652,019 | B1 | 11/2003 | Bennett |
| 6,682,127 | B2 | 1/2004 | Jones et al. |
| 6,722,287 | B2 | 4/2004 | Norton et al. |
| 6,824,341 | B2 | 11/2004 | Ehrlich |
| 6,832,808 | B1 | 12/2004 | Bennett |
| 6,866,330 | B2 | 3/2005 | Jones et al. |
| 6,893,075 | B2 | 5/2005 | Fenton et al. |
| 6,979,051 | B2 | 12/2005 | Jones et al. |
| 6,986,546 | B2 | 1/2006 | Ehrlich |
| 7,066,529 | B2 | 6/2006 | Yurgevich et al. |
| 7,069,702 | B2 | 7/2006 | Ehrlich |
| 7,100,971 | B2 | 9/2006 | Pines |
| 7,134,820 | B2 | 11/2006 | Ehrlich |
| 7,152,912 | B1 | 12/2006 | Roush et al. |
| 7,258,391 | B2 | 8/2007 | Graaff et al. |
| 7,540,085 | B2 | 6/2009 | Fenton et al. |
| 7,854,577 | B2 | 12/2010 | Green |
| 2001/0024055 | A1 | 9/2001 | Ehrlich |
| 2002/0098053 | A1 | 7/2002 | Zubko |
| 2002/0157565 | A1 | 10/2002 | Norton et al. |
| 2002/0180238 | A1 | 12/2002 | Sill |
| 2003/0080583 | A1 | 5/2003 | Jones et al. |
| 2003/0080586 | A1 | 5/2003 | Ehrlich |
| 2003/0127253 | A1 | 7/2003 | Heyn |
| 2004/0104597 | A1 | 6/2004 | Jones et al. |
| 2004/0217631 | A1 | 11/2004 | Ehrlich |
| 2004/0239147 | A1 * | 12/2004 | Fenton ..... B62D 33/04 296/186.1 |
| 2005/0074309 | A1 | 4/2005 | Ehrlich |
| 2005/0116504 | A1 | 6/2005 | Yurgevich et al. |
| 2005/0134086 | A1 | 6/2005 | Jones et al. |
| 2005/0161977 | A1 | 7/2005 | Fenton et al. |
| 2006/0028050 | A1 | 2/2006 | Ehrlich |
| 2006/0061136 | A1 | 3/2006 | Pines |
| 2006/0237993 | A1 | 10/2006 | Wiebe |

FOREIGN PATENT DOCUMENTS

| | | |
|---|---|---|
| CA | 2320016 | 3/2009 |
| CH | 478688 | 11/1969 |
| DE | 3737210 | 5/1989 |
| DE | 269594 | 7/1989 |
| DE | 3835671 | 4/1990 |
| EP | 0206542 | 12/1986 |
| EP | 119668 | 9/1987 |
| EP | 401391 | 12/1990 |
| EP | 618130 | 10/1994 |
| FR | 2504236 | 10/1982 |

(56) References Cited

FOREIGN PATENT DOCUMENTS

| | | |
|---|---|---|
| GB | 2152869 | 8/1985 |
| WO | WO 92/13782 | 8/1992 |
| WO | WO 94/00369 | 1/1994 |

OTHER PUBLICATIONS

Stoughton Drawing No. 04-12314, Revision B, dated Mar. 12, 1990.
Stoughton Drawing No. 04-13776, Revision D, dated Jun. 2, 1992.
Stoughton Drawing No. 04-14891, dated Jan. 4, 1994.
Stoughton Drawing No. 04-18581, dated Jan. 8, 1999.
Stoughton Trailers, Inc.; Stoughton Model AEDCW—Domestic Container brochure; Aluminum, Exterior Post, Hi-Cube; published prior to May 2002.
Stoughton Trailers, Inc.; Stoughton Model ASDCW—Domestic Container brochure; Aluminum, Smooth Side, Hi-Cube; published prior to May 2002.
Stoughton Trailers, Inc.; Stoughton New Doubles Van brochure; Feb. 1998.
Stoughton Trailers, Inc.; Stoughton New HI-Cube Plate Van brochure; Apr. 1997.
Stoughton Trailers, Inc.; Stoughton We'll change the way you look at trailers brochure; Sep. 2000.
Stoughton Trailers, Inc.; Stoughton Z-Plate Vans brochure; published prior to Sep. 2005.
Highway Trailers Industries, Inc.; Highway System brochure; published prior to Sep. 2005.
Request for Proposal from Schneider National, Inc. to Stoughton Trailers, LLC, Feb. 23, 2004, 2 pages, Statement of Relevance attached.
Sales Order from Stoughton Trailers, LLC, Apr. 28, 2004, 4 pages, Statement of Relevance attached.
Letter to Mr. David Giesen from E. Loyd Manasco of Stoughton Trailers, LLC, Mar. 15, 2004, 3 pages, Statement of Relevance attached.

* cited by examiner

CONTAINER WITH SUPPORTS

CROSS-REFERENCE TO RELATED APPLICATIONS

This application is a divisional of co-pending U.S. patent application Ser. No. 11/514,431 filed on Sep. 1, 2006, which claims priority to U.S. Provisional Patent Application No. 60/713,877 filed on Sep. 2, 2005, the entire contents of both of which are incorporated herein by reference.

BACKGROUND

Containers, often transported by trucks, commercial nautical vessels, trains, and the like, are typically subject to heavy loading and rugged use. In many applications, such containers are stacked on top of one another. Use of containers in a stacking configuration requires that a container be designed not only to hold a given load within the container, but also to provide structural support for a substantial external load applied vertically to the container. While providing sufficient strength for stacking, it is also desired to design a container with a large internal volume for maximizing cargo carrying capacity.

SUMMARY

Some embodiments of the present invention provide a support structure for a commercial storage and transport container having a roof and a sidewall, wherein the support structure comprises an upper handling fitting having an external surface defined at least in part by a recessed portion and an adjacent unrecessed portion; a header extending at least partially across the roof of the transport container to the upper handling fitting, the header coupled to the upper handling fitting; and a stacking post extending at least partially across the sidewall of the transport container to the upper handling fitting, the stacking post coupled to the upper handling fitting and received in overlapping relationship within the recessed portion of the external surface of the upper handling fitting.

In some embodiments, a support structure for a commercial storage and transport container having a sidewall and a floor is provided, and comprises a lower handling fitting having an external surface defined at least in part by a recessed portion and an adjacent unrecessed portion; a support located in the floor of the container and coupled to the lower handling fitting; and a stacking post extending at least partially across the sidewall of the transport container to the lower handling fitting, the stacking post coupled to the lower handling fitting and received in overlapping relationship within the recessed portion of the external surface of the lower handling fitting.

Some embodiments of the present invention provide a stacking post for a commercial storage and transport container, wherein the stacking post has a longitudinal axis, and comprises an exterior wall; an interior wall coupled to the exterior wall to define an interior of the stacking post; a first internal longitudinally-extending compartment between the interior and exterior walls; and a second internal longitudinally-extending compartment running alongside the first compartment and separated from the first compartment; wherein the stacking post has a cross-sectional shape taken along a plane perpendicular to the longitudinal axis of the stacking post; and wherein the cross-sectional shape of the stacking post is substantially flat and planar.

Further aspects of the present invention, together with the organization and operation thereof, will become apparent from the following detailed description of the invention when taken in conjunction with the accompanying drawings.

DETAILED DESCRIPTION

Before any embodiments of the present invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
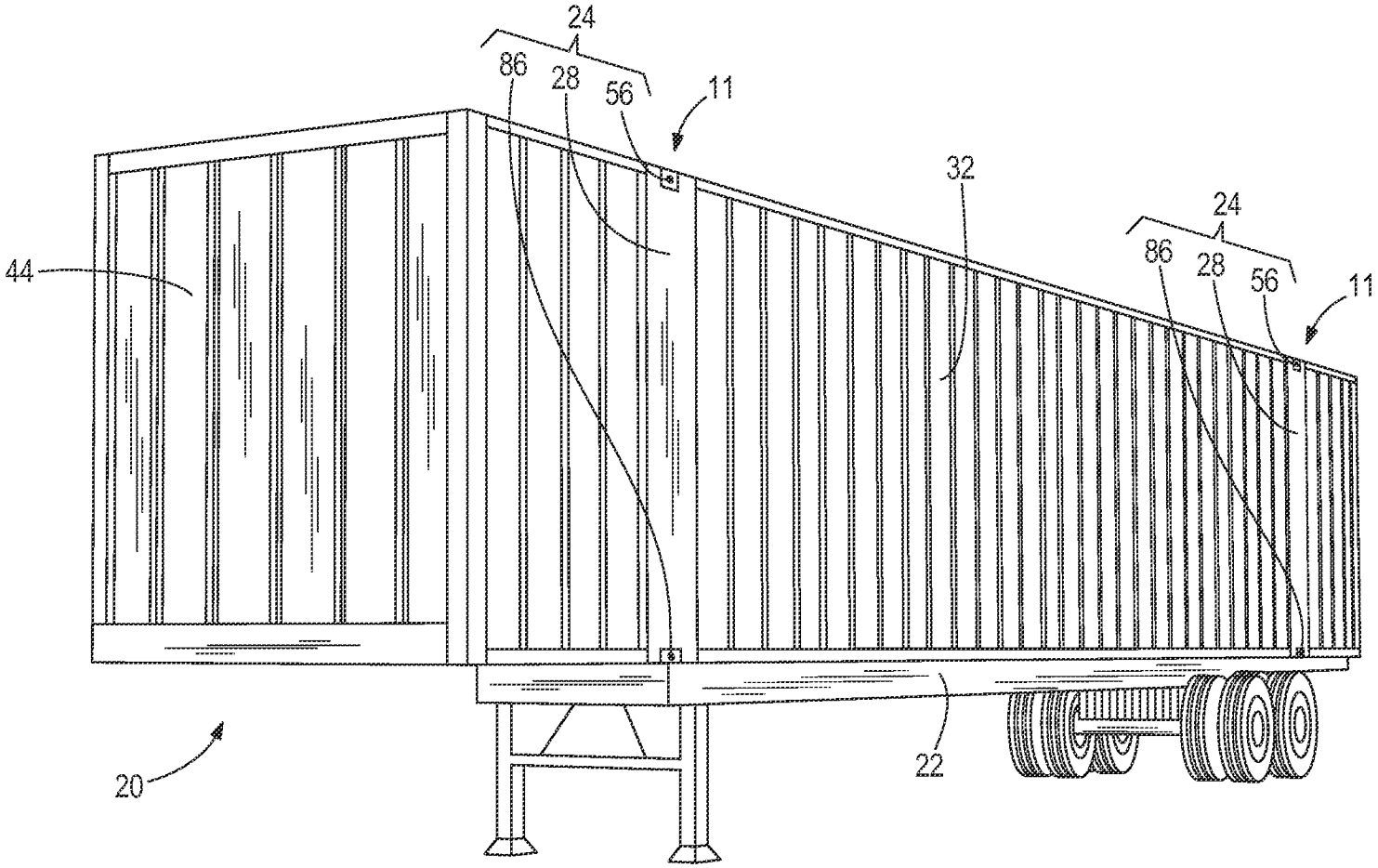
FIG. 1 is a perspective view of a container adapted for over-the-road use.
Figure 2:
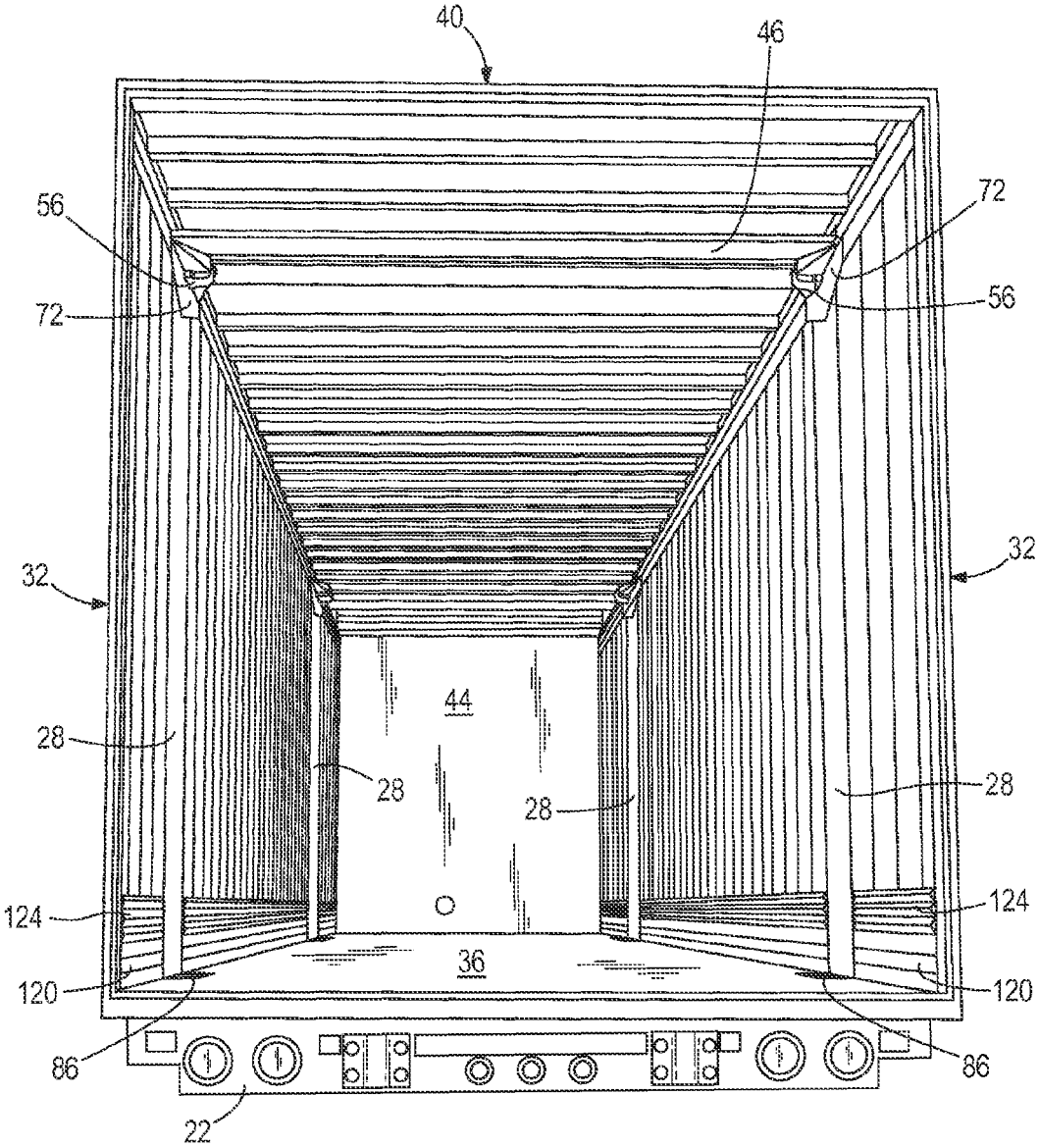
FIG. 2 is a perspective view of the interior of the container illustrated in FIG. 1.

A commercial storage and transport container 20 is illustrated in FIGS. 1 and 2, and is shown mounted on a chassis 22. The illustrated container 20 is provided with frames 11 each having support structures 24. The container 20 can have any number of frames 11, which are provided to increase the load-bearing capacity of the container 20. The frames 11 can be located anywhere along the length of the container 20, such as at the ends thereof, less than half the length of the container 20 from either or both ends of the container 20, proximate the middle of the container 20, and the like. In the illustrated embodiment, for example, the container 20 has two frames 11, each located a distance from a respective end of the container 20.

Each support structure 24 in the illustrated embodiment includes a stacking post 28 for enabling containers 20 to be stacked atop one another. The stacking posts 28 are arranged along the sides of the container 20, and in some embodiments, at least partially define two sidewalls 32 of the container. The container 20 also includes a floor 36, a roof 40, and end walls 44 to collectively define an interior volume of the container 20. The interior volume (shown in FIG. 2) can be utilized for holding virtually any type of cargo. As mentioned above, the container 20 illustrated in FIGS. 1 and 2 is mounted on the chassis 22 for over-the-road use. The container 20 may also or instead be used for transport by rail, ship, or in any other manner, and can also be used for storing cargo for varying lengths of time, such as in a shipping yard, dock, or other location.

Figure 3:
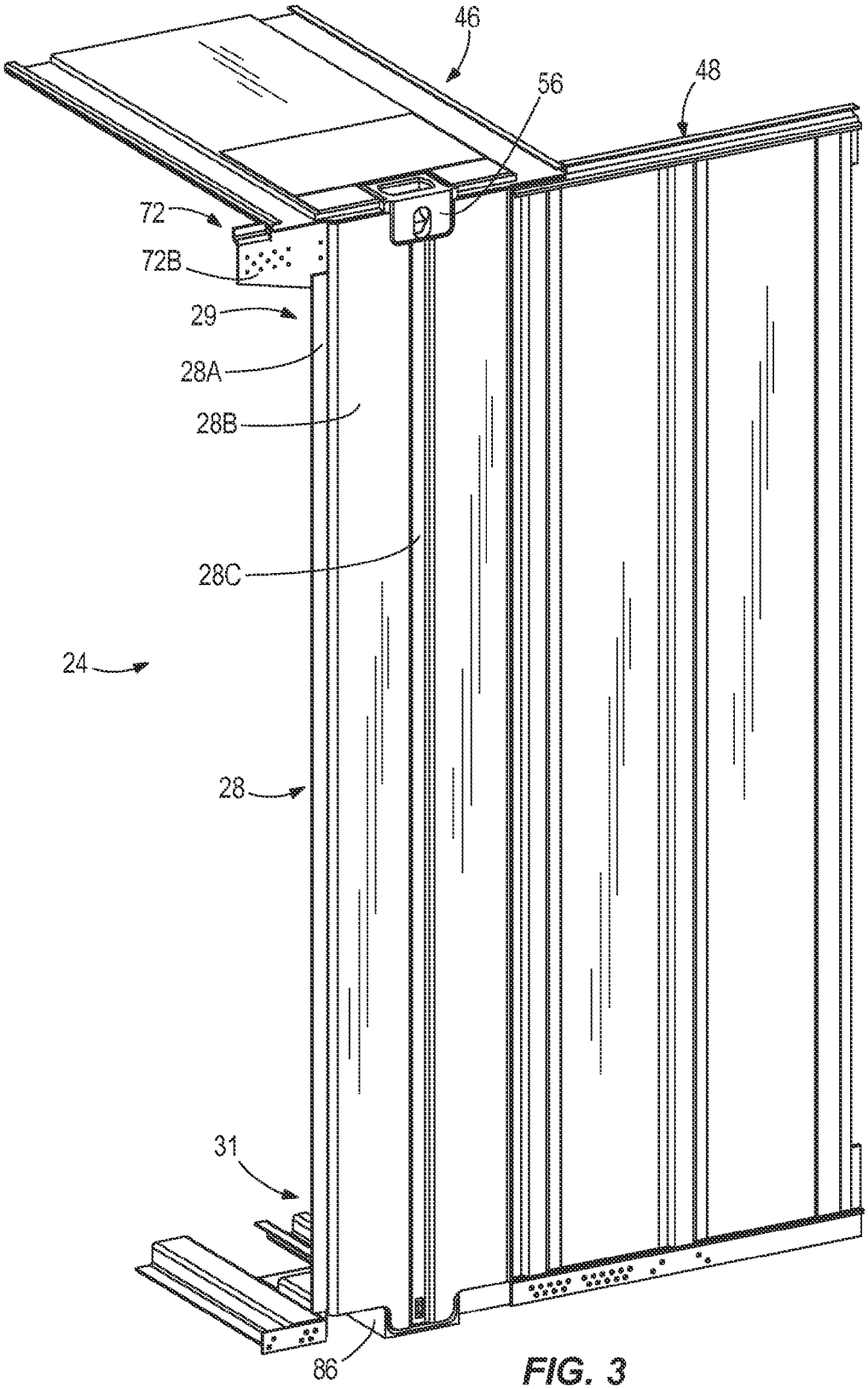
FIG. 3 is a perspective view of a portion of the container illustrated in FIGS. 1 and 2, showing a support structure of a frame with an attached container side panel.
Figure 4:
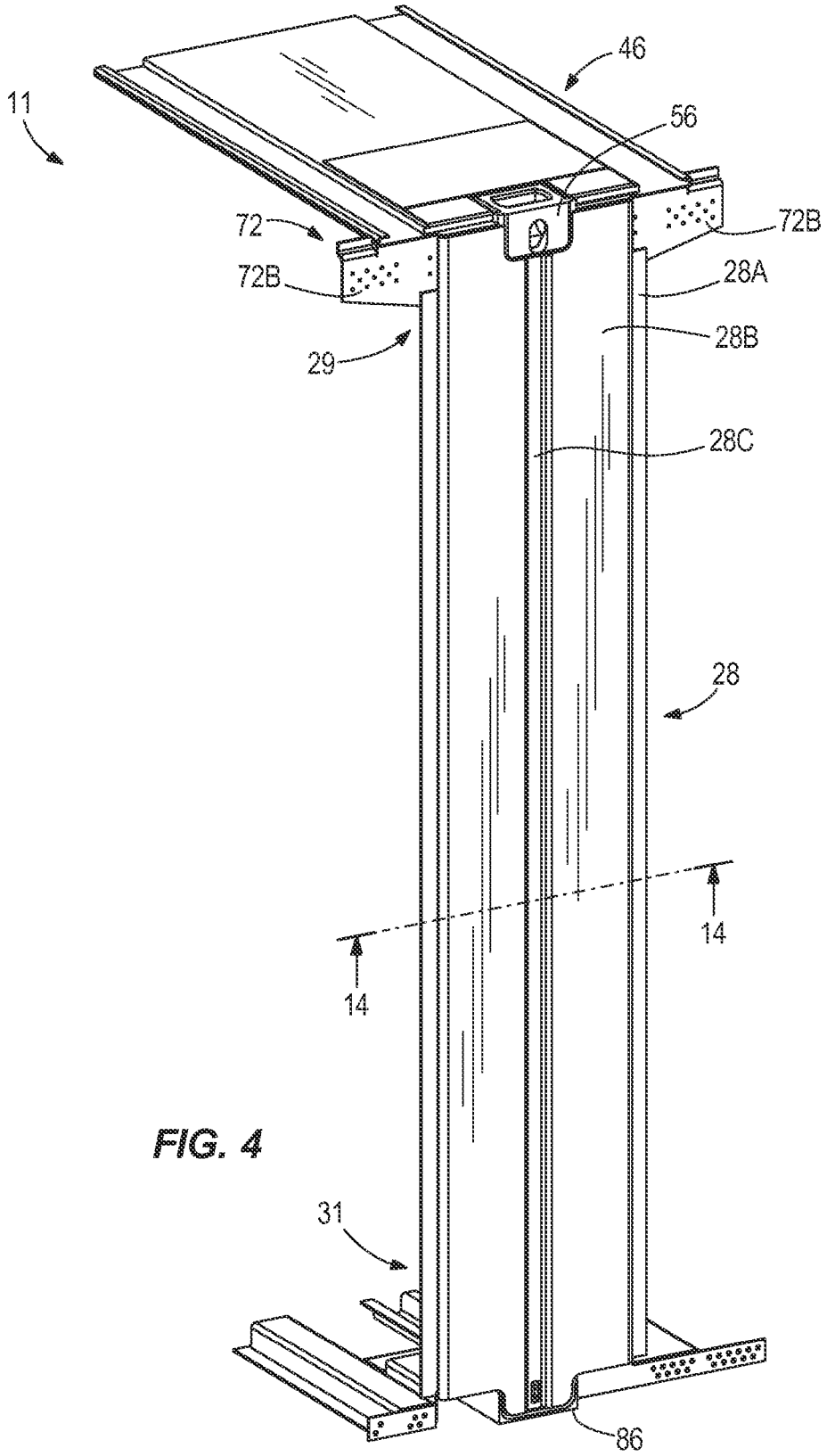
FIG. 4 is a perspective view of the support structure illustrated in FIG. 3.
Figure 5:
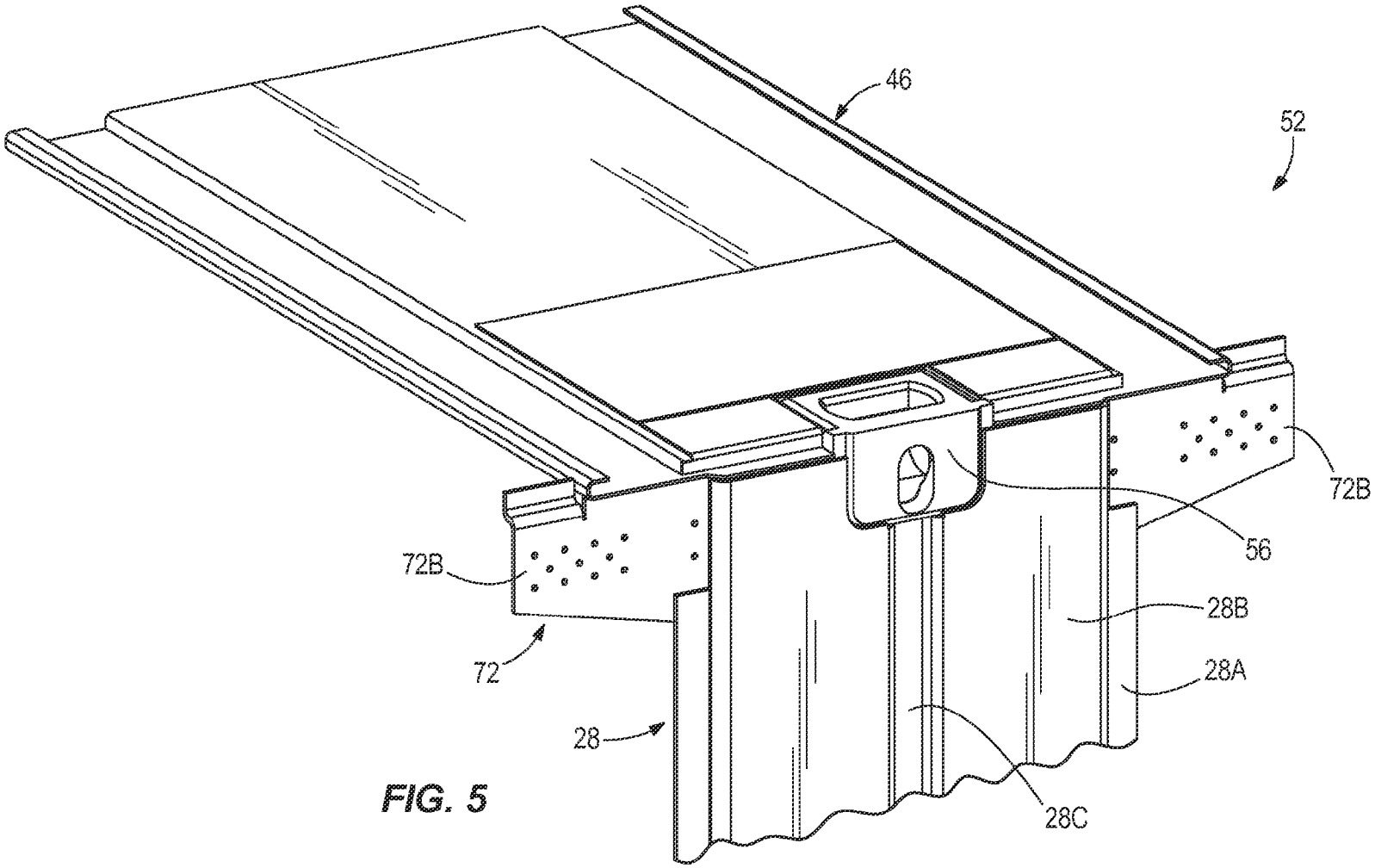
FIG. 5 is a perspective detail view of an upper end of a support structure illustrated in FIGS. 3 and 4.

FIGS. 3-4 illustrate an embodiment of a support structure 24. The support structure 24 can comprise the stacking post 28, an upper handling fitting 56, and a lower handling fitting 86. In other embodiments, the support structure 24 comprises only the stacking post 28, or the stacking post 28 and either of the upper and lower handling fittings 56, 86.

The stacking post 28 generally has upper portion and lower portions 29, 31 located adjacent the roof 40 and floor 36 of the container 20, respectively. In the illustrated embodiment, the upper portion 29 is connected to one end of a header 46 running along the roof 40 to another stacking post 28 on an opposite sidewall 32 of the container 20 (not visible in FIGS. 3 and 4). In other embodiments, the stacking post 28 is not connected to a header 46, but is instead directly or indirectly connected to any other component of the roof 40. Also with reference to the illustrated embodiment, the lower portion 31 is connected to components of the floor 36 as will be described in greater detail below.

In some embodiments, the stacking post 28 includes separate inner and outer portions 28A, 28B (see FIG. 14) connected to one another by welding or brazing. Alternatively, the inner and outer portions 28A, 28B can be connected together in any other suitable manner, such as by adhesive or cohesive bonding material, rivets, screws, bolts, pins, or other conventional fasteners, inter-engaging elements on the inner and outer portions 28A, 28B, and the like. In other embodiments, the inner and outer portions are integrally formed with one another by any suitable manufacturing process, such as by extrusion, casting, molding, machining, and the like.

In order to strengthen the stacking post 28, the stacking post 28 can be compartmentalized. In particular, the walls of the stacking post 28 can be shaped to define two or more compartments 33 (e.g., see FIG. 14). The compartments 33 can be substantially closed with respect to one another, although a fluid-tight seal between the compartments 33 is not required in some embodiments. The compartments 33 can have any shape desired. In some embodiments, each compartment 33 has a substantially flat and elongated cross-sectional shape (taken along a section substantially perpendicular to the longitudinal axis of the stacking post 28).

To provide additional strength and rigidity to the stacking post 28, one or more walls of the stacking post 28 can be corrugated, thereby defining one or more corrugations 35 running longitudinally along the stacking post 28. For example, either or both portions 28A, 28B of the stacking post 28 described above can have longitudinally-extending corrugations 35 (see FIG. 14). The stacking post 28 in the illustrated embodiment has a single corrugation 35 defining a channel 28C running longitudinally along the length of the stacking post 28. One or more corrugations 35 can run the entire length of the stacking post 28 as shown in the illustrated embodiment, can run substantially the entire length or a majority of the length of the stacking post 28, or can run any other fraction of the length of the stacking post 28. Also, any number of longitudinally-running corrugations 35 can be defined in the stacking post 28, and can be located anywhere along the width of the stacking post 28, such as a single corrugation 35 centrally located along the width of the illustrated stacking post 28, two or more regularly or irregularly-spaced corrugations 35 along the width of the stacking post 28, and the like.

In those embodiments in which the stacking post 28 has one or more corrugations 35, the corrugations 35 can at least partially define one or more compartments 33 of the stacking post 28 (described above). In other embodiments, separate compartments 33 in the stacking post 28 are defined by one or more internal walls within the stacking post 28. The geometry of the stacking post 28 is described in greater detail below.

FIG. 3 illustrates the support structure 24 with a side panel 48 of the container 20 attached thereto. The illustrated side panel 48 overlaps the stacking post 28 on a side edge thereof. In some embodiments, a longitudinally-extending recess 37 (see FIG. 14) is defined by the first and/or second portions 28A, 28B of the stacking post 28, enabling the side panel 48 to be recessed within the stacking post 28 and to thereby present a smooth interior and/or exterior surface of the sidewall 32. For example, in the illustrated embodiment, the inner section 28A of the stacking post 28 extends laterally beyond the outer section 28B. This relationship between the inner and outer sections 28A, 28B provides a location for the adjacent side panel 48 to overlap the inner section 28A and to thereby be recessed within the stacking post 28. In some embodiments, a surface of the side panel 48 can therefore be flush with an adjacent surface of the stacking post 28, thereby providing a substantially smooth inner and/or outer surface of the sidewall 32. Also, by utilizing a stacking post shape in which one of the stacking post sections 28A, 28B extends laterally beyond the other stacking post section 28B, 28A, the stacking post 28 is provided with a portion to which the side panel 48 can be secured, such as by welding, brazing, adhesive or cohesive bonding material, rivets, screws, bolts, pins, or other conventional fasteners, inter-engaging elements on the side panel 48 and on the inner or outer portions 28A, 28B of the stacking post 28, and the like.

Although a single side panel 48 is illustrated in FIG. 3, the side walls 32 of the container 20 can be constructed of a series of overlapping side panels 48. For example, the support structure 24 illustrated in FIG. 3 can be connected as described above to a side panel 48 on either side of the stacking post 28. FIG. 4 illustrates the support structure 24 with adjacent side panels 48 removed for clarity.

Figure 9:
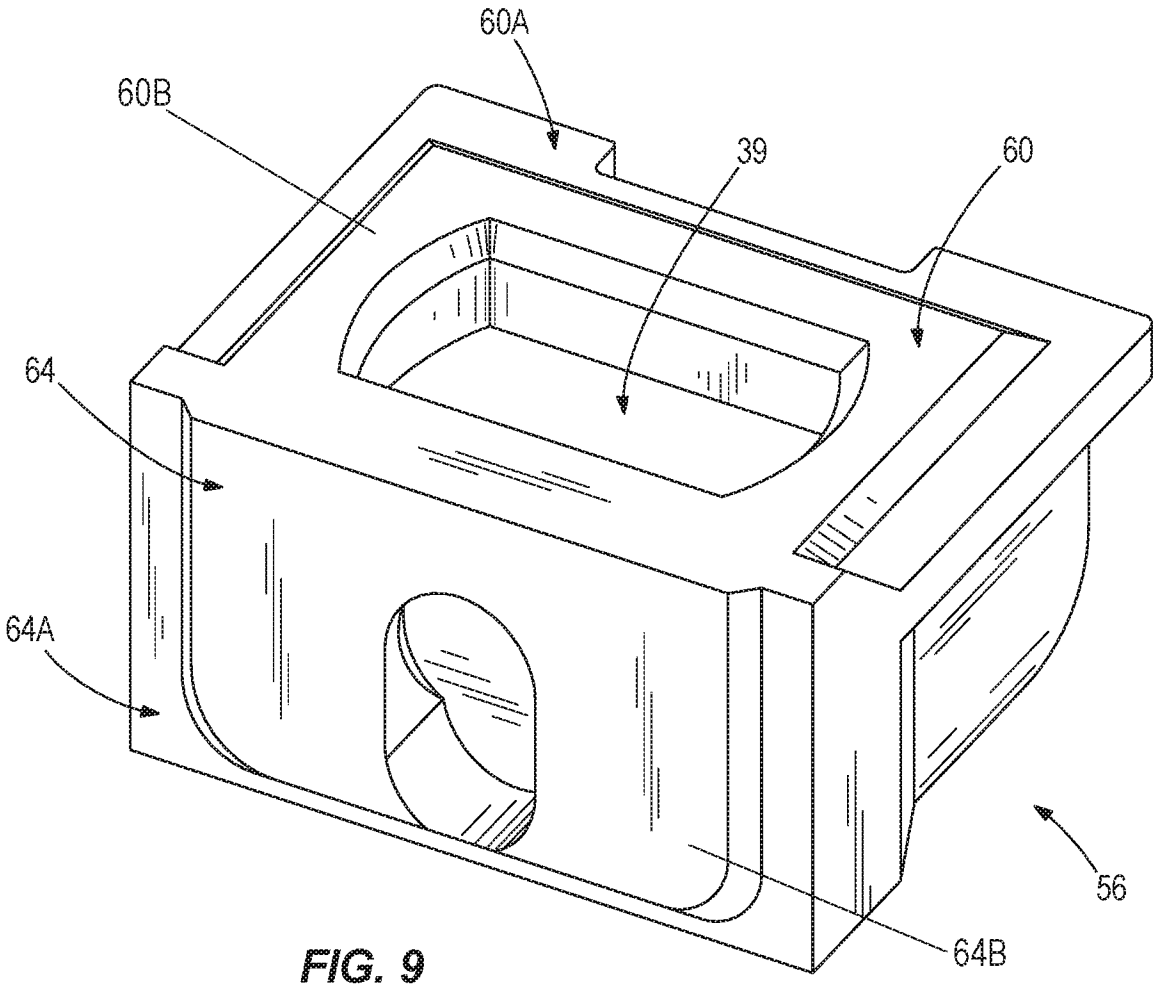
FIG. 9 is a perspective view of the upper handling fitting illustrated in FIGS. 1-8.

FIGS. 5-8 illustrate an upper portion of the support structure 24 shown in FIGS. 3 and 4, including an upper joint 52 at the upper portion 29 of the stacking post 28. An upper handling fitting 56 is located adjacent the upper portion 29 of the stacking post 28. The upper handling fitting 56 provides an attachment location for machinery that lifts or otherwise manipulates the container 20 and/or for devices adapted to releasably connect the container 20 to adjacent containers. The upper handling fitting 56 illustrated in detail in FIG. 9 is provided with an internal cavity 39 for allowing insertion of a tool, such as a hook, for lifting, manipulating, and/or connecting the container 20 as mentioned above. The internal cavity 39 can have any shape and size suitable for this purpose, and can have any number of access holes located anywhere in the upper handling fitting 56 (two in the illustrated embodiment—one for side access to the internal cavity 39, and one for top access to the internal cavity 39) for tool insertion.

The upper handling fitting 56 illustrated in FIG. 9 is generally parallelepiped in shape, with an upper surface 60, an outer surface 64, and the like. Peripheral recesses 60A and 64A are recessed from unrecessed portions 60B, 64B of the upper surface 60 and outer surface 64, respectively, in the illustrated embodiment. One or more portions of the roof 40 (e.g., the header 46, in the illustrated embodiment) can be received within the peripheral recess 60A and/or one or more portions of the side wall 32 (e.g., the stacking post 28, in the illustrated embodiment) can be received within the peripheral recess 64A. In this manner, an overlapping relationship can be provided between the stacking post 28 and roof and wall components.

With reference to FIGS. 5-8, for example, the illustrated header 46 is received in the peripheral recess 60A in overlapping relationship with the upper handling fitting 56, thereby providing an improved connection area between the header 46 and the upper handling fitting 56. The header 46 and the upper handling fitting 56 can be connected at and proximate the peripheral recess 60A by welding or brazing, or in any of the other connection manners described above with regard to the connection between the stacking post 28 and the side panel 48.

In some embodiments, the header 46 can have a shape corresponding to the shape of the recess 60A in which the header 46 is received. In the illustrated embodiment, for example, the header 46 is provided with a cutout 68 to enable adjacent portions of the header 46 to overlie or overlap the recess 60A on the upper surface 60 of the upper handling fitting 56. In this and other embodiments, the header 46 can be relatively flush with the unrecessed upper surface 60 not covered or overlapped by the header 46. The resulting improved overlapping connection area stands in contrast to conventional manners of connection in which the header 46 simply abuts the upper handling fitting 56, can provide a solid and more secure header-to-upper handling fitting connection with improved weldability, and in some embodiments can provide greater strength for and resistance against shear and torque loads placed upon the upper joint 52. Also, this arrangement can help to minimize the thickness of the upper joint 52 as a whole, as well as intrusion of components of the upper joint 52 into the interior of the container 20.

The upper handling fitting 56 in the illustrated embodiment is provided with a peripheral recess 60A for receiving adjacent portions of the header 46 (or other roof portion, as described above). In other embodiments, the upper handling fitting 56 can have one or more recesses located in other portions of the upper handling fitting 56 and/or having other shapes for receiving one or more adjacent portions of the header 46. For example, the upper surface 60 of the upper handling fitting 56 can have a central groove into which a protrusion on the end of the header 46 is received for connection, in which case the protrusion of the header 46 can have an aperture permitting access therethrough to the top aperture of the upper handling fitting 56. Still other recess shapes, sizes, and locations (peripheral to the upper surface 60 or otherwise) are possible, and fall within the spirit and scope of the present invention.

With continued reference to FIGS. 5-8, the illustrated stacking post 28 is received in the peripheral recess 64A in overlapping relationship with the upper handling fitting 56, thereby providing an improved connection area between the stacking post 28 and the upper handling fitting 56. The stacking post 28 and the upper handling fitting 56 can be connected at and proximate the peripheral recess 64A by welding or brazing, or in any of the other connection manners described above with regard to the connection between the stacking post 28 and the side panel 48.

In some embodiments, the stacking post 28 can have a shape corresponding to the shape of the recess 64A in which the stacking post 28 is received. In the illustrated embodiment, for example, the upper portion 29 of the stacking post 28 is provided with a pair of cutouts 70A and 70B in the inner and outer sections 28A, 28B, respectively. The cutouts 70A, 70B enable adjacent portions of the outer section 28B of the stacking post 28 to overlie or overlap the recess 64A on the outer surface 64 of the upper handling fitting 56, and can also provide a joint at which the inner section 28A can be joined to the upper handling fitting 56. The cutouts 70A and 70B can be different or substantially the same in size and shape in order to facilitate such connection of the stacking post 28 to the upper handling fitting 56. In this and other embodiments, the outer surface of the stacking post 28 can be relatively flush with the unrecessed outer surface 64 not covered or overlapped by the stacking post 28. The resulting improved overlapping connection area stands in contrast to conventional manners of connection in which the stacking post 28 simply abuts the upper handling fitting 56, can provide a solid and more secure stacking post-to-upper handling fitting connection with improved weldability (in some cases, to both the inner and outer sections 28A, 28B of the stacking post 28), and in some embodiments can provide greater strength for and resistance against shear and torque loads placed upon the upper joint 52. In addition, the cutouts 70A, 70B in the stacking post 28 allow the upper handling fitting 56 to be easily accessed when needed. Also, this arrangement can help to minimize the thickness of the upper joint 52 as a whole, as well as intrusion of components of the upper joint 52 into the interior of the container 20.

The upper handling fitting 56 in the illustrated embodiment is provided with a peripheral recess 64A for receiving adjacent portions of the stacking post 28 (or other sidewall component 32, as described above). In other embodiments, the upper handling fitting 56 can have one or more recesses located in other portions of the upper handling fitting 56 and/or having other shapes for receiving one or more adjacent portions of the stacking post 28. For example, the outer surface 64 of the upper handling fitting 56 can have a central groove into which a protrusion on the upper end of the stacking post 28 is received for connection (in which case the protrusion of the stacking post 28 can have an aperture permitting access therethrough to the side aperture of the upper handling fitting 56). Still other recess shapes, sizes, and locations (peripheral to the outer surface 64 or otherwise) are possible, and fall within the spirit and scope of the present invention.

Figure 6:
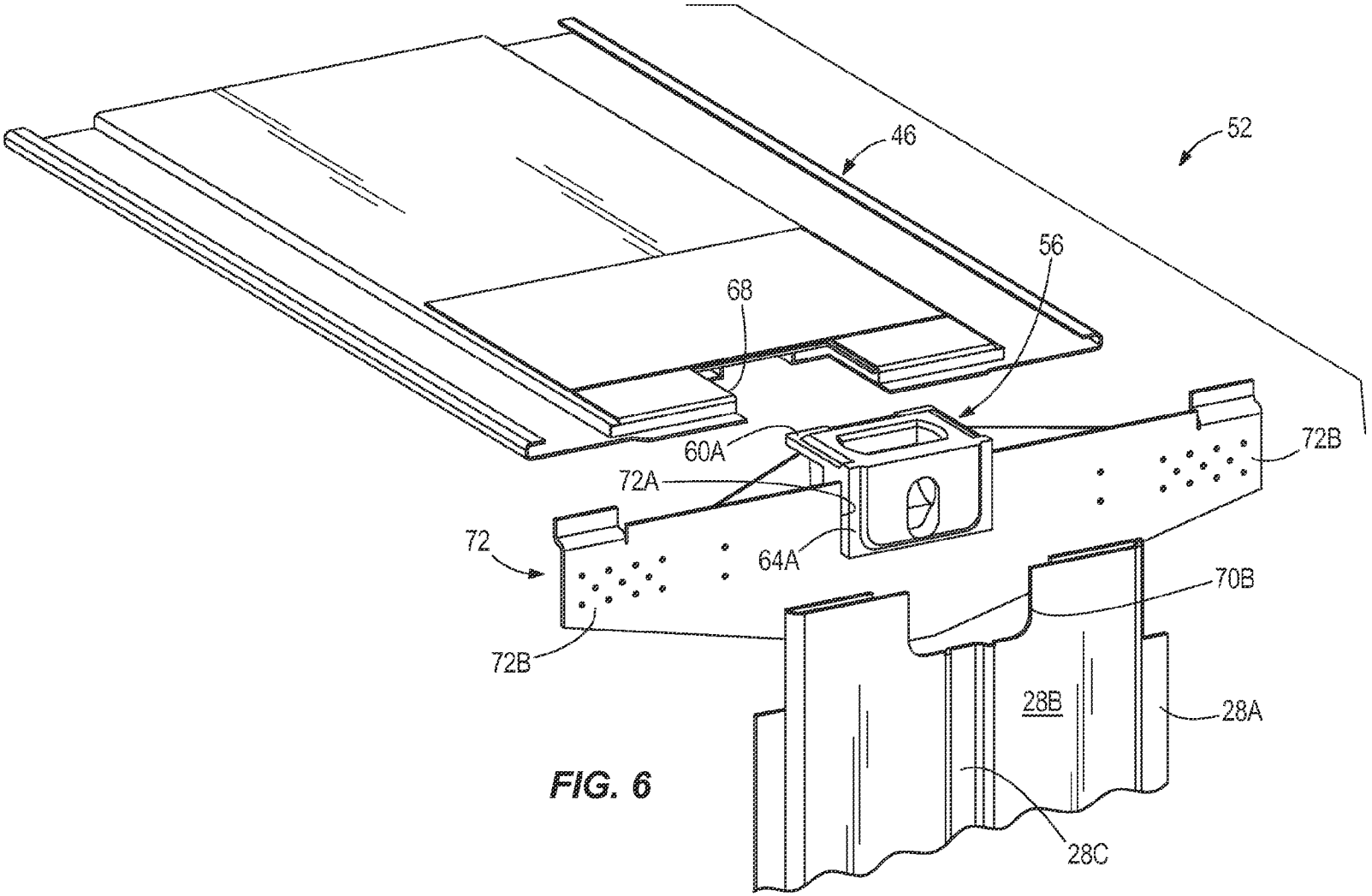
FIG. 6 is an exploded perspective view of the upper end of the support structure illustrated in FIG. 5.
Figure 7:
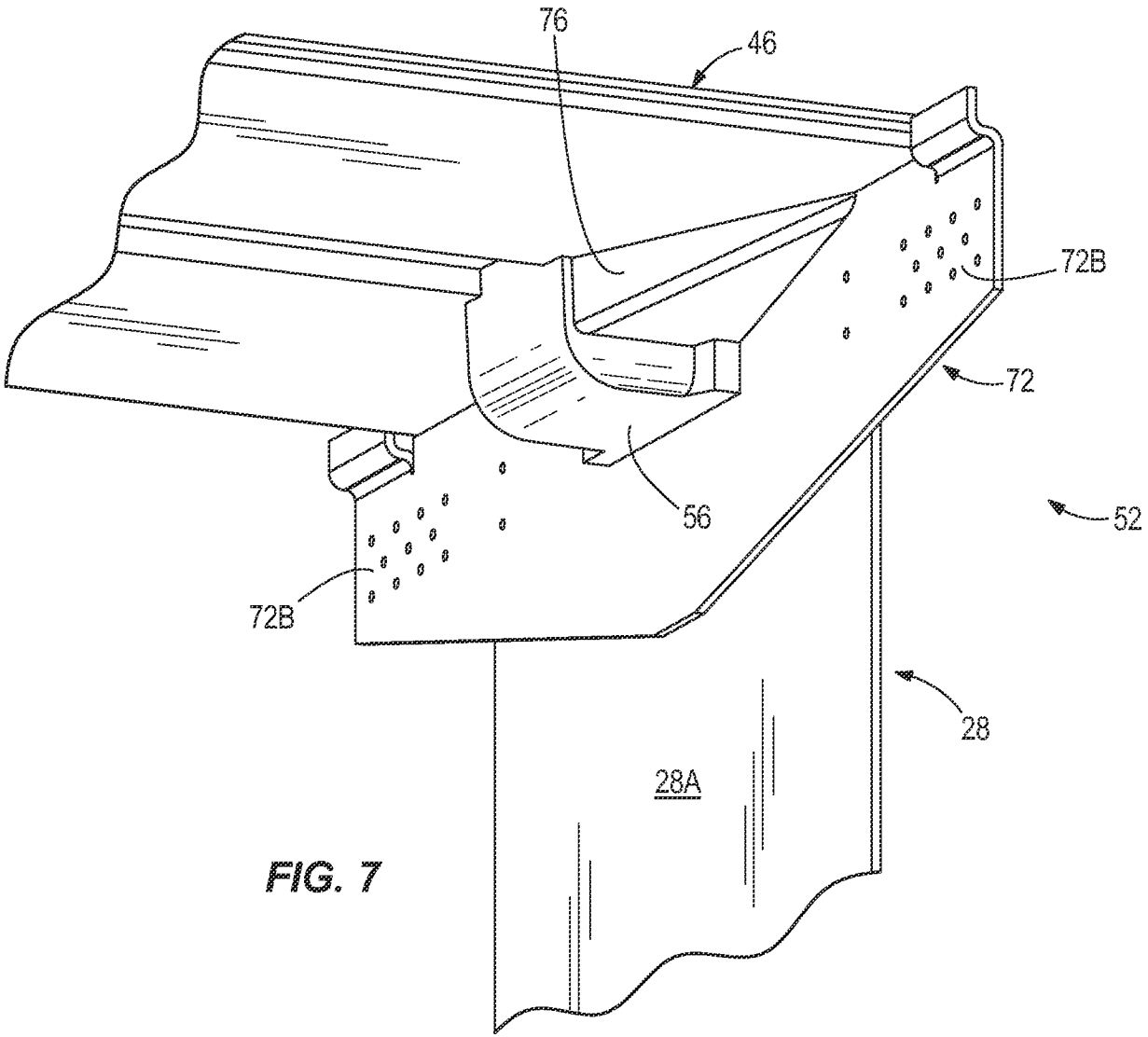
FIG. 7 is another perspective view of the upper end of the support structure illustrated in FIGS. 5 and 6.
Figure 8:
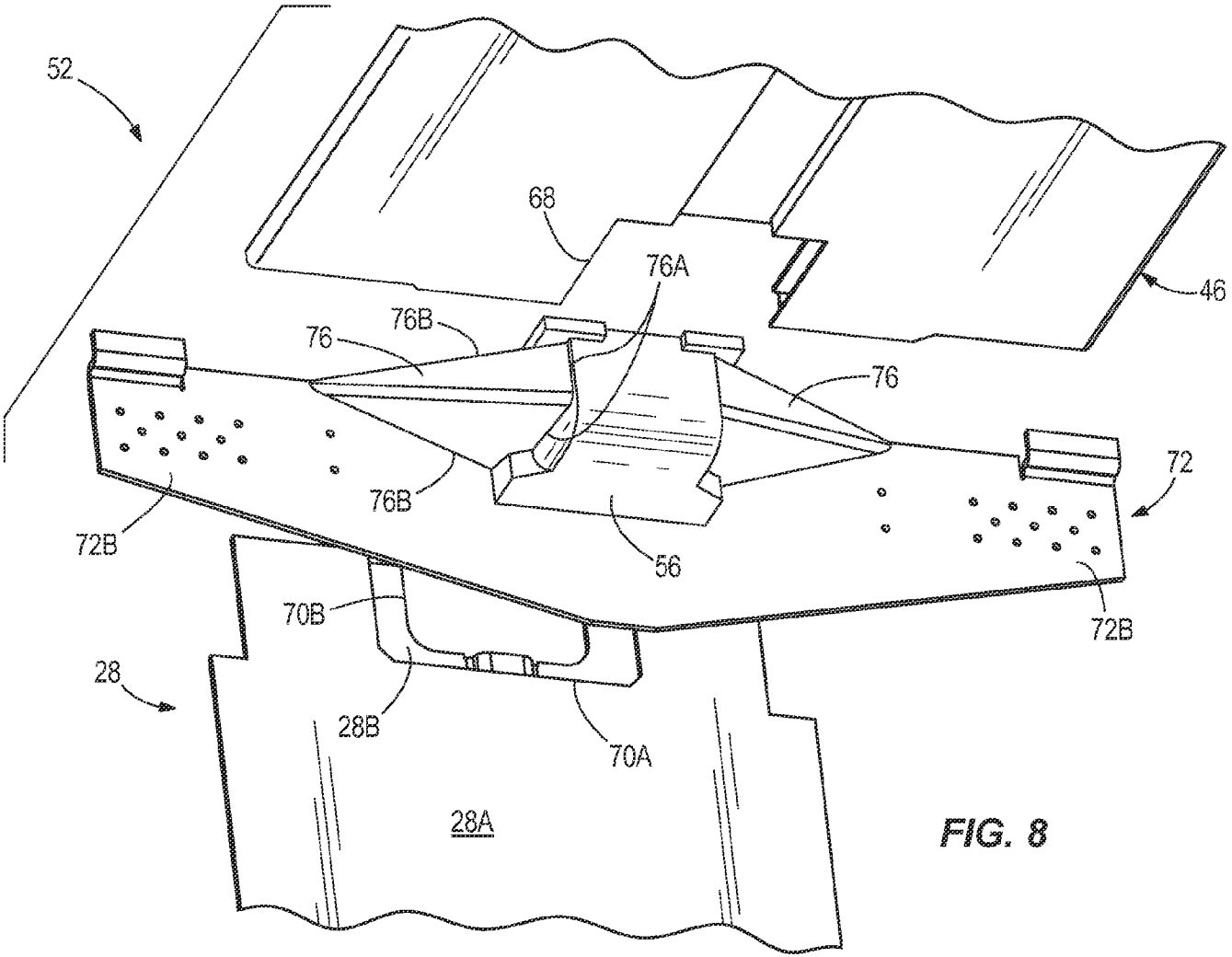
FIG. 8 is another exploded perspective view of the upper end of the support structure illustrated in FIGS. 5-7.

In some embodiments, the upper joint 52 is reinforced with a member connected to the upper handling fitting 56 and/or to the upper portion 29 of the stacking post 28, and also connected to side panels 48 on either or both sides of the frame 11 in order to further distribute loads from the upper joint 52. For example, the support structure 24 in the illustrated embodiments includes a wing 72 positioned on an inside of the upper joint 52 and connected to the upper handling fitting 56, stacking post 28, and adjacent side panels 48. The wing 72 can have any shape suitable for such connections, and in the illustrated embodiment is designed to receive the upper handling fitting 56 in a cutout 72A as illustrated in FIG. 6. The wing 72 can be attached to the upper handling fitting 56 and/or to the stacking post 28 by welding or brazing along the interface between these support structure components. Also, in some embodiments, the wing 72 can close the inside of the stacking post 28 in addition to distributing loads within the support structure 24 as described above. Outer portions 72B of the wing 72 can be provided with apertures for attachment to the side panels 48 flanking the stacking post 28. Rivets, pins, screws, bolts, or other conventional fasteners can be used to connect the wing 72 to the side panels 48 at these locations. In other embodiments, the wing 72 can be connected to the side panels 48, to the upper handling fitting 56, and/or to the stacking post 28 in any of the other connection manners described above with regard to the connection between the stacking post 28 and the side panels 48.

In some embodiments, additional strength can be provided to the upper joint 52 by one or more gussets 76 connected to the upper handling fitting 56, header 46 (or other roof component), wing 72 (if utilized), and/or stacking post 28. Such gussets 76 can help distribute load from the upper joint 52, and in some embodiments can help to deflect cargo being moved into or out of the container 20. For example, and with reference to FIGS. 7 and 8 which illustrate the upper joint 52 of the illustrated embodiment from an interior perspective, the upper joint 52 can be provided with two gussets 76 secured to opposite sides of the header 46, to the upper handling fitting 56 and to the wing 72. In alternative embodiments, such as where the wing 72 is not utilized or is shaped differently, the gussets 76 can be attached directly to the stacking post 28. The upper joint 52 can be provided with a single gusset 76, a gusset 76 on the three exposed sides of the upper handling fitting 56 in the illustrated embodiment, or any other number of gussets 76. The gussets 76 can be attached to any combination of the upper handling fitting 56, header 46, wing 72, and stacking post 28 in any of the manners described above with regard to the connection between the stacking post 28 and the side panels 48. In the illustrated embodiment, for example, the gussets 76 are welded to the upper handling fitting 56, the header 46, and the wing 72. Also, the gussets 76 can extend away from the upper handling fitting 56 in any direction, such as in forward and rearward directions as shown in the illustrated embodiment.

The gussets 76 can take any shape desired, and in the illustrated embodiment are generally triangularly prismatic. The gussets 76 in the illustrated embodiment have two faces at an angle (e.g., approximately 90 degrees) with respect to one another. In some embodiments, the gussets 76 each have two short legs 76A abutting a side face of the upper handling fitting 56, and attached thereto in any of the manners described above. Two long legs 76B of the gusset 76 can extend outwardly from the upper handling fitting 56, and can run along the wing 72 and header 46 to provide relatively elongated seams for connection of the gusset 76 thereto. In some embodiments, the gussets 76 are not permanently fixed, and can instead be removably attached to one or more of the upper joint components. The shape of the gussets 76 in the illustrated embodiment promotes a deflecting action to protect the upper handling fitting 56 from impacts with cargo moving within the container 20. This acts to not only protect the upper handling fitting 56, but also the cargo. It can also make loading and unloading cargo easier by reducing the risk of cargo snagging.

Figure 10:
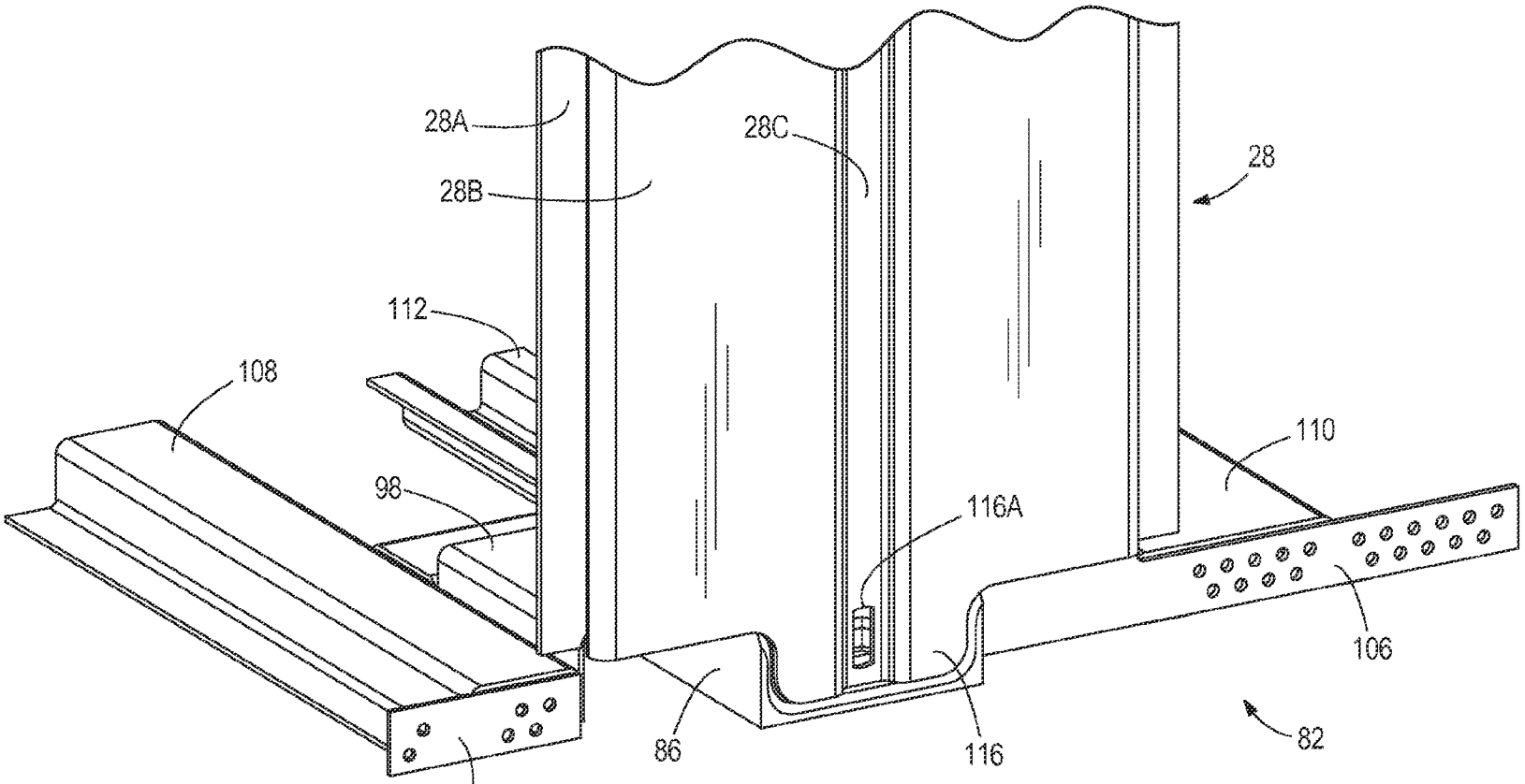
FIG. 10 is a perspective view of a lower end of the support structure illustrated in FIGS. 3 and 4.
Figure 11:
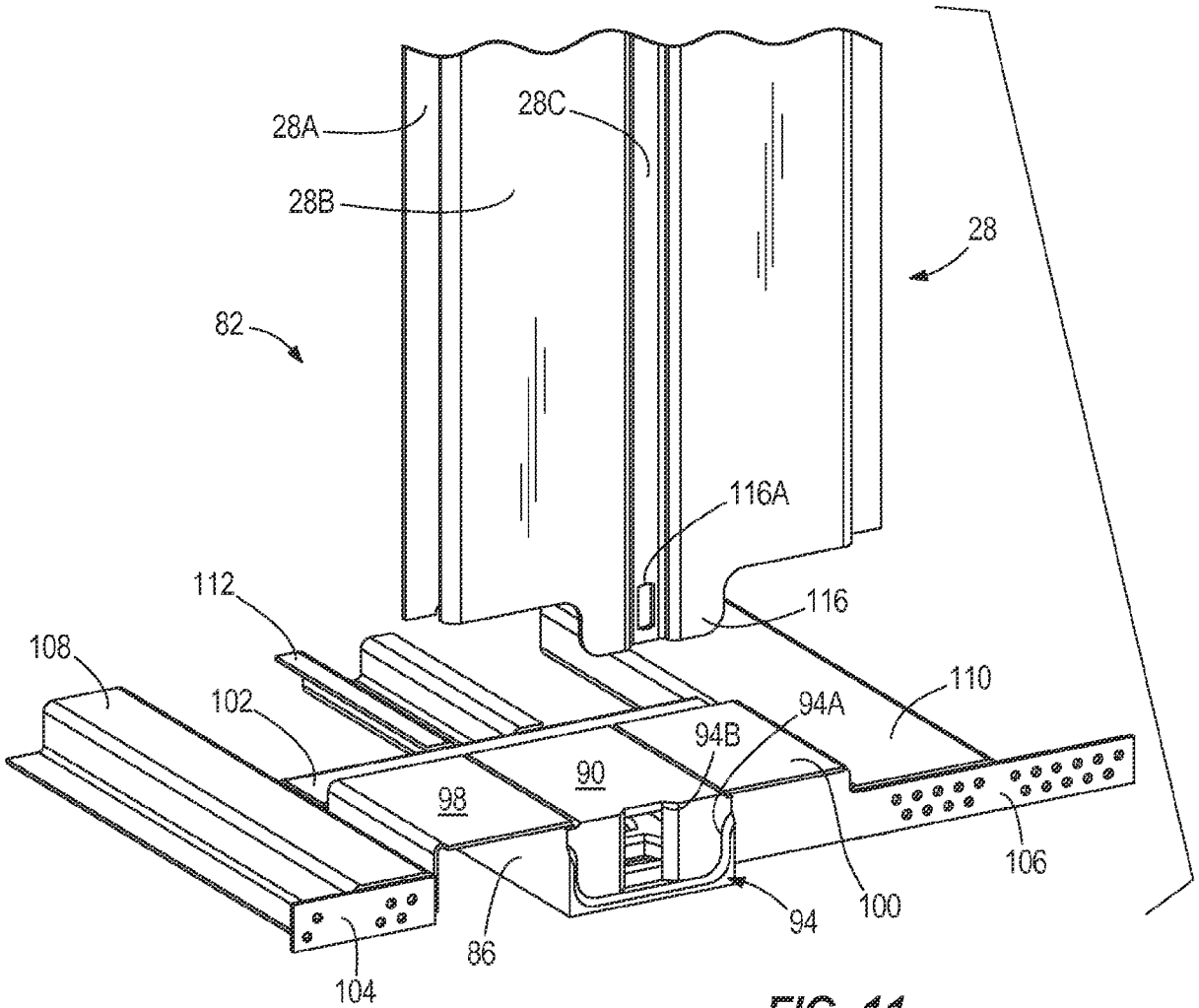
FIG. 11 is a partially exploded perspective view of the lower end of the support structure illustrated in FIG. 10.
Figure 12:
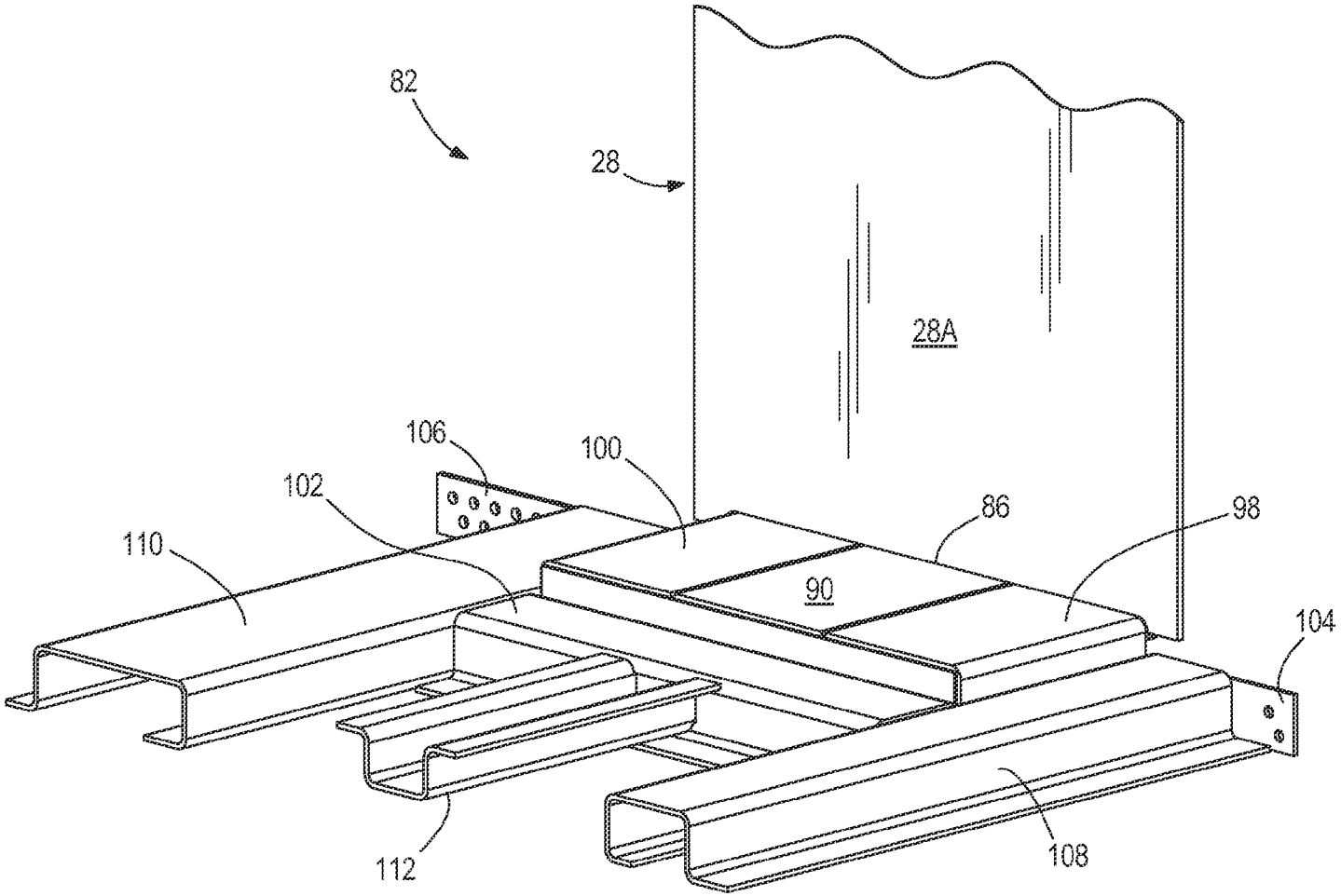
FIG. 12 is another perspective view of the lower end of the support structure illustrated in FIGS. 10 and 11.
Figure 13:
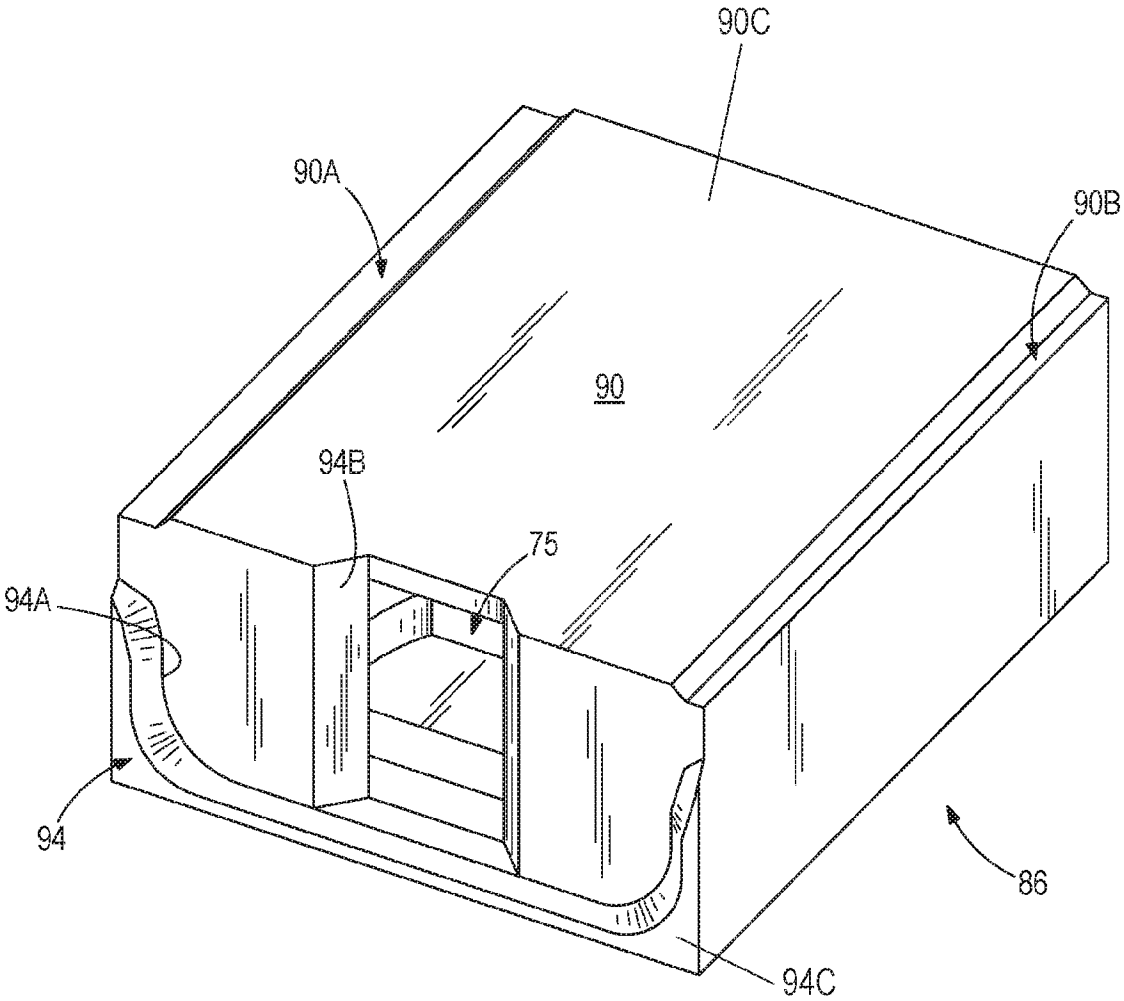
FIG. 13 is a perspective view of the lower handling fitting illustrated in FIGS. 1, 3, 4, and 10-12.

FIGS. 10-12 illustrate a lower portion of the support structure 24 shown in FIGS. 1-14, including a lower joint 82 formed at the lower portion 31 of the stacking post 28 adjacent the lower handling fitting 86. The lower handling fitting 86 provides an attachment location for machinery that lifts or otherwise manipulates the container 20 and/or for devices adapted to releasably connect the container 20 to adjacent containers. The lower handling fitting 86 illustrated in detail in FIG. 13 is provided with an internal cavity 75 for allowing insertion of a tool, such as a hook, for lifting, manipulating, and/or connecting the container 20 as mentioned above. The internal cavity 75 can have any shape and size suitable for this purpose, and can have any number of access holes located anywhere in the lower handling fitting 86 (two in the illustrated embodiment—one for side access to the internal cavity 75, and one for bottom access to the internal cavity 75) for tool insertion.

The lower handling fitting 86 illustrated in FIG. 13 is generally parallelepiped in shape, with an upper surface 90, an outer surface 94, and the like. In the illustrated embodiment, peripheral recesses 90A, 90B are recessed from an unrecessed portion 90C of the upper surface 90, while another recess 94A is defined with respect to an unrecessed portion 94C of the outer surface 94. Also, the lower handling fitting 86 is provided with a notch 94B located in the recess 94A.

With continued reference to FIGS. 10-12, the illustrated stacking post 28 is received in the recess 94A in overlapping relationship with the lower handling fitting 86, thereby providing an improved connection area between the stacking post 28 and the lower handling fitting 86. The stacking post 28 and the lower handling fitting 86 can be connected at and proximate the recess 94A by welding or brazing, or in any of the other connection manners described above with regard to the connection between the stacking post 28 and the side panels 48.

In some embodiments, the stacking post 28 can have a shape corresponding to the shape of the recess 94A in which the stacking post 28 is received. In the illustrated embodiment, for example, the lower portion 31 of the stacking post 28 is provided with a downwardly protruding tab 116 centrally located along the width of the stacking post 28 and in line with the structural channel 28C. The tab 116 is configured to fit in the recess 94A, while the portion of the channel 28C that extends along the tab 116 fits into the notch 94B. An opening 116A in the tab 116 allows access to the internal cavity 75 of the lower handling fitting 86 when needed.

The tab 116 and recess 94A enables adjacent portions of the stacking post 28 to overlie or overlap the recess 94A on the outer surface 94 of the lower handling fitting 86, and can also provide a joint at which the stacking post 28 can be joined to the lower handling fitting 86. In this and other embodiments, the outer surface of the stacking post 28 can be relatively flush with the unrecessed outer surface 94 not covered or overlapped by the stacking post 28. The resulting improved overlapping connection area stands in contrast to conventional manners of connection in which the stacking post 28 simply abuts the lower handling fitting 86, can provide a solid and more secure floor-to-lower handling fitting connection with improved weldability (in some cases, to both the inner and outer sections 28A, 28B of the stacking post 28), and in some embodiments can provide greater strength for and resistance against shear and torque loads placed upon the lower joint 82.

The lower handling fitting 86 in the illustrated embodiment is provided with a recess 94A for receiving the tab 116 of the stacking post 28 (or other sidewall component 32, in other embodiments). In other embodiments, the lower handling fitting 86 can have one or more recesses located in other portions of the lower handling fitting 86 and/or having other shapes for receiving one or more adjacent portions of the stacking post 28. For example, the outer surface 94 of the lower handling fitting 86 can instead have a peripheral recess in which corresponding portions of the stacking post 28 are received for connection to the lower handling fitting 86. Still other recess shapes, sizes, and locations (peripheral to the outer surface 94 or otherwise) are possible, and fall within the spirit and scope of the present invention.

With continued reference to FIGS. 10-12, the lower joint 82 of the illustrated support structure 24 also includes supports 98, 100, and 102, end plates 104 and 106, and beams 108, 110, and 112. The beams 108, 110, and 112 extend from the lower joint 82 across the floor 36 of the container 20 to a second lower joint (not shown) on the opposite side of the container 20. Any number of beams 108, 110, 112 can extend from the lower joint 82 in this manner, and can be directly or indirectly connected to the lower joint 82 in any of the manners described above with regard to the connection between the stacking post 28 and the side panels 48. The beams 108, 110, and 112 in the illustrated embodiment are not shown in full length for clarity. Each of the first, second, and third beams 108, 110, and 112 have a partially-boxed or channel-shaped cross section. Other cross-sectional shapes are acceptable for use in the present invention.

In the illustrated embodiment, two of the beams 108, 110 abut first and second end plates 104, 106 at and end adjacent the container side wall 32. The first and second end plates 104 and 106 can be provided with apertures for attaching the side panels 48. Rivets, pins, screws, bolts, or other conventional fasteners can be used to connect the end plates 104, 106 to the side panels 48 at these locations. In other embodiments, the first and second end plates 104, 106 can be connected to the side panels 48 in any of the other connection manners described above with regard to the connection between the stacking post 28 and the side panels 48.

The third beam 112 can also be welded or secured to the third support 102 in any of the connection manners described above with regard to the connection between the stacking post 28 and the side panels 48. In some embodiments, the third support 102 abuts the lower handling fitting 86, such as on an interior side of the lower handling fitting 86, and can be welded or secured to the lower handling fitting 86, or can be connected thereto in any of the connection manners described above with regard to the connection between the stacking post 28 and the side panels 48.

First and second supports 98 and 100 are secured to the lower handling fitting 86 in the illustrated embodiment, and are connected thereto at respective recesses 90A, 90B (see FIG. 13) in the upper surface 90 of the lower handling fitting 86. The first and second supports 98, 100 are generally right angle brackets in the illustrated embodiment, each having a portion for coupling to a respective beam 108 and 110. Other configurations for connection of the lower handling fitting 86 and lower end 31 of the stacking post 28 to floor components of the container 20 are possible. For example, one or more beams 108, 110, 112 can be positioned and shaped so that one or more portions (e.g., flanges or other edges) of such beams overlap the recesses 90A, 90B. As another example, some embodiments of the container 20 do not employ a support 102 extending between the beams 108, 110 and to which the beam 112 is attached. In such embodiments, the beam 112 can extend to the lower handling fitting 86, and can overlap one or more recesses 90A, 90B of the lower handling fitting 86 for connection thereto in any manner described herein. Still other configurations for connection of the lower handling fitting 86 and lower end 31 of the stacking post 28 to floor components of the container 20 are possible, and fall within the spirit and scope of the present invention.

Two of the illustrated supports 98, 100 (or other floor structure, as described above) are received in the peripheral recesses 90A, 90B in overlapping relationship with the lower handling fitting 86, thereby providing an improved connection area between the supports 98, 100 and the lower handling fitting 86. The supports 98, 100 and the lower handling fitting 86 can be connected at and proximate the peripheral recesses 90A, 90B by welding or brazing, or in any of the other connection manners described above with regard to the connection between the stacking post 28 and the side panels 48.

In some embodiments, the supports 98, 100 (or other floor structure, as described above) can have shapes corresponding to the shapes of the recesses 90A, 90B in which the supports 98, 100 are received. In the illustrated embodiment, for example, straight edges of the supports 98, 100 overlie or overlap the recesses 90A, 90B on the upper surface 90 of the lower handling fitting 86. In this and other embodiments, the supports 98, 100 can be relatively flush with the unrecessed upper surface 90 not covered or overlapped by the supports 98, 100. The resulting improved overlapping connection area stands in contrast to conventional manners of connection in which floor components simply abut the lower handling fitting 86, can provide a solid and more secure floor component-to-lower handling fitting connection with improved weldability, and in some embodiments can provide greater strength for and resistance against shear and torque loads placed upon the lower joint 82. Also, this arrangement can help to minimize the thickness of the lower joint 82 as a whole, as well as intrusion of components of the lower joint 82 into the interior of the container 20.

The lower handling fitting 86 in the illustrated embodiment is provided with two peripheral recesses 90A, 90B for receiving adjacent portions of the supports 98, 100 (or other floor portions, as described above). In other embodiments, the lower handling fitting 86 can have one or more recesses located in other portions of the lower handling fitting 86 and/or having other shapes for receiving one or more adjacent portions of the supports 98, 100 or other floor components. For example, the upper surface 90 of the lower handling fitting 86 can have one or more central grooves into which protrusions on the supports 98, 100, 102 are received for connection. Still other recess shapes, sizes, and locations (peripheral to the upper surface 90 or otherwise) are possible, and fall within the spirit and scope of the present invention.

While the upper joint 52 and the lower joint 82 have been described above with relation to the illustrated embodiment, it should be understood that some properties and features of the illustrated embodiment are interchangeable or replaceable. For example, the illustrated stacking post 28 features the cutout 70 at the upper portion 29, and the tab 116 at the lower portion 31. If the upper and lower handling fittings 56 and 86 are modified, the locations of the cutout 70 and tab 116 can be switched. In other embodiments, the upper and lower handling fittings 56, 86 can have the same manner of connection as described herein (i.e., two cutout connections, two tab connections, and the like). Additionally, those of skill in the art will appreciate that alternate constructions of the stacking post 28 and the upper and lower joint components, among other components, may be utilized within the scope of the invention.

Figure 14:
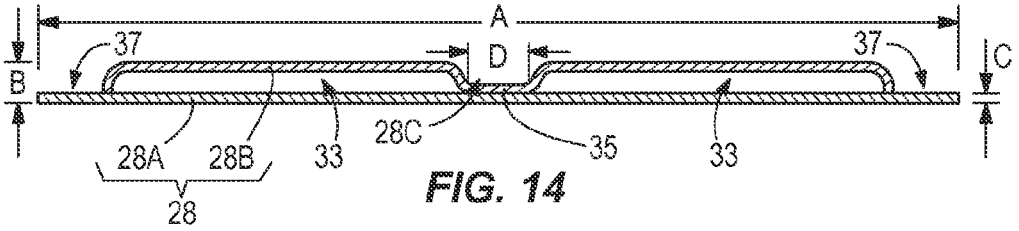
FIG. 14 is a cross-sectional view of a stacking post, taken along line 14-14 of FIG. 4.

An embodiment of a stacking post 28 is illustrated in FIG. 14. The stacking post 28 has a width A, a post thickness B, and a material thickness C. The height of the stacking post 28 can be determined at least in part by the height of the container 20. In some embodiments, the stacking post 28 has a width A of no less than about 45.72 centimeters (18 inches) and no greater than about 76.2 centimeters (30 inches). For example, in some embodiments, the stacking post 28 has a width A of approximately 58.4 centimeters (23 inches). Also, in some embodiments, the stacking post 28 has a post thickness B no less than about 2.03 centimeters (0.80) inches and no greater than about 2.54 centimeters (1.00 inch), such as a stacking post thickness of about 2.38 centimeters (0.9375 inches). The post thickness B is measured from an interior surface of the inner section 28A to an exterior surface of the outer section 28B (i.e., measuring the entire thickness of the stacking post 28). In some embodiments, the inner and outer sections 28A and 28B have a material thickness C of no less than about 3.30 millimeters (0.13 inches) and no greater than about 6.35 millimeters (0.25 inches), such as a material thickness C of approximately 4.76 millimeters (0.1875 inches).

In some embodiments, the ratio of the width A of the stacking post 28 to the thickness B of the stacking post 28 is no greater than about 45 and is no less than about 15. Also, in some embodiments, a ratio of stacking post width A to thickness B is no greater than about 30 and is no less than about 15. A ratio of stacking post width A to thickness B of no greater than about 25 and no less than about 20 provides good performance results in some embodiments.

In the illustrated embodiment, the structural channel 28C can increase the strength and/or stiffness of the stacking post 28, as described above. The channel 28C can have a width D and a depth equal to the post thickness B minus the material thickness C. In some embodiments, the depth-to-width ratio is no less than about 0.06 and is no greater than about 0.8. For example, the depth-to-width ratio of the channel 28C can be about 0.2. A ratio for the width A of the stacking post 28 to the width D of the channel 28C may also be expressed. In some embodiments, such a ratio is no less than about 12 and is no greater than about 24. For example, the ratio of the width A of the stacking post 28 to the width D of the channel 28C can be about 18.4. The values given above can represent dimensions relating to a stacking post 28 with a channel 28C as shown and described herein, but applies equally to similar constructions in which multiple stiffening regions (i.e., channels, ridges, and the like) are used.

The support structures 24 described and illustrated herein can provide a stackable container 20 having a thin-walled construction with a smooth interior surface (i.e., no protruding stacking posts 28) over the entire length thereof. This reduces interference with loading and unloading operations, can eliminate the need to add an interior lining, can preserve a maximum amount of cargo space inside the container 20, can simplify cleaning of the container 20, can reduce the weight and manufacturing costs of the container 20, and can reduce the costs associated with container repair in the event of sidewall damage (in light of the fact that an internal lining need not be removed and replaced). The thin-walled construction is enabled at least in part by the thin cross-section of the stacking posts 28. The configuration of the joints 52 and 82 of the support structure 24 also allows the exterior width of the container 20 to conform to industry standard or legal limits while the interior width is increased for added cargo carrying capacity.

Figure 15:
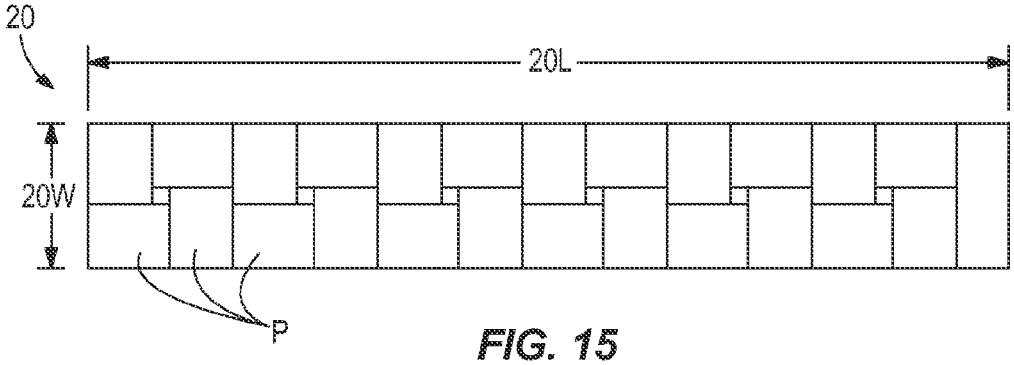
FIG. 15 is a first schematic loading configurations for a container according to certain aspects of the present invention.
Figure 16:
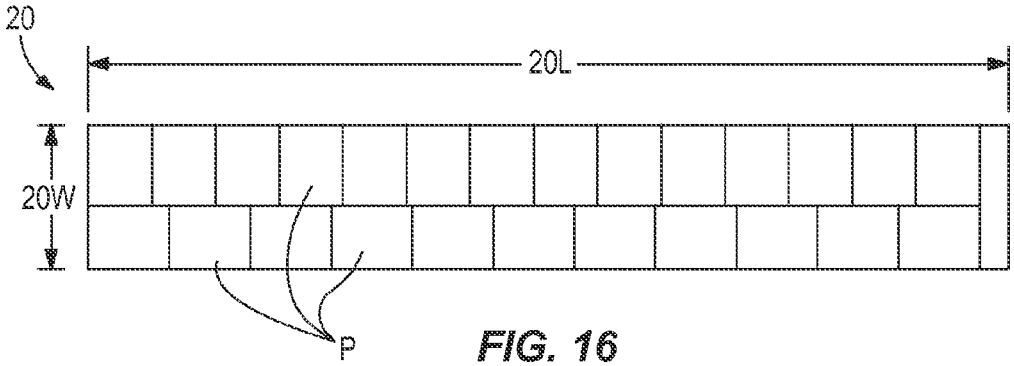
FIG. 16 is a second schematic loading configurations for a container according to certain aspects of the present invention.
Figure 17:
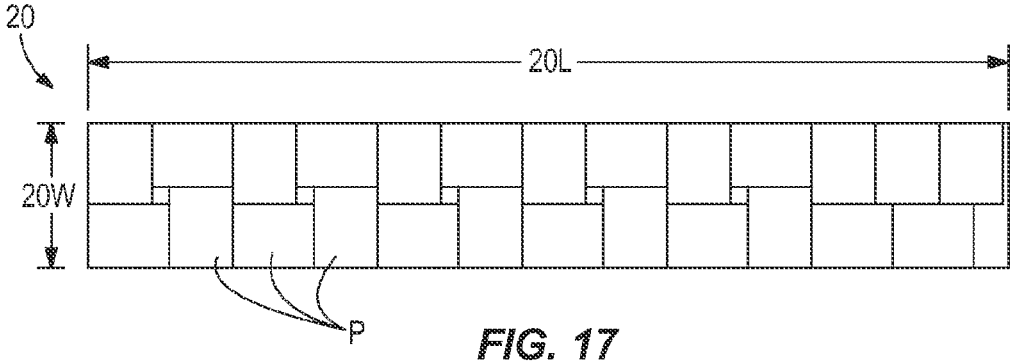
FIG. 17 is a third schematic loading configurations for a container according to certain aspects of the present invention.

The frame 11 and support structures 24 described and illustrated herein can be used in a container 20 having a length 20L of about 16.15 meters (53 feet). The container 20 can be stackable by virtue of the strength of the frames 11, but need not be used in such a configuration. Despite having the stacking posts 28 and handling fittings 56 and 86, the container 20 can still provide an interior width 20W of over 2.54 meters (100 inches) based at least in part upon the support structures 24 described and illustrated herein. This is especially useful for pinwheel loading standard 111.76 cm by 142.24 cm (44-inch by 56-inch) pallets P as illustrated in FIGS. 15 to 17. Pinwheel loading involves loading a pallet P lengthwise and another pallet P widthwise across the width 20W of the container 20 at a given position along the length 20L of the container 20. Because such pallets P therefore require exactly 2.54 meters (100 inches) to be pinwheel loaded, containers 20 utilizing support structures 24 according to some embodiments of the present invention can provide an interior width 20W between the side walls 32 of 256.22 centimeters (100⅞ inches) (and in some embodiments, 254.95 centimeters (100⅜ inches) at the stacking posts 28), thereby providing the necessary width for pinwheel loading and an additional amount of clearance. Referring back to FIG. 2, a pair of lower rails 120 and a pair of scuff guards 124 can even be used. Scuff guards 124 can project slightly into the interior width 20W of the container 20 while still leaving about 254.95 centimeters (100⅜ inches) of loadable width in the exemplary embodiment.

With an interior width 20W at or above 2.54 meters (100 inches), the loading flexibility of the container 20 is significantly improved. While providing a gain in width over conventional containers, the interior width 20W of over 2.54 meters (100 inches) allows more effective use of space by enabling pinwheel loading of standard 111.76 cm by 142.24 cm (44-inch by 56-inch) pallets P, utilizing essentially the entire width 20W of the container 20. The schematic configurations in FIGS. 15-17 illustrate this ability. FIG. 15 illustrates a 16.15-meter (53-foot) container 20 pinwheel loaded with 24 pallets P. FIGS. 16 and 17 illustrate the 16.15-meter (53-foot) container 20 pinwheel loaded with 25 pallets P in two different manners. A conventional stackable container with an interior width of less than 2.54 meters (100 inches) is typically capable of loading 22 pallets P, and is not capable of pinwheel loading at all. Thus, the container 20 can provide an obvious advantage in cargo capacity and efficiency, requiring either fewer trips or containers 20 to transport a given amount of cargo, or allowing more cargo to be transported with a given number of trips or containers 20.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, any of the stacking posts 28 described and illustrated herein can be provided with cargo fitting apertures at any location(s) along the length of the stacking posts 28. In some embodiments, the cargo fitting apertures can be located in the channel 28C of the stacking post 28, thereby providing an area within the channel 28 for receiving cargo fittings recessed within the channel 28C. However, in other embodiments, the cargo fitting apertures can be located elsewhere across the width A of the stacking post 28. Any number of such cargo fitting apertures can be located along the length of the stacking post 28.

What is claimed is:

1. A support structure for a commercial storage and transport container, the storage and transport container comprising a roof and a sidewall, the support structure comprising:

an upper handling fitting having an outer surface and an upper surface, the outer surface being defined at least in part by a recessed portion and an adjacent unrecessed portion, the outer surface facing in a lateral direction to an exterior of the support structure;

a header extending at least partially across the roof of the transport container to the upper handling fitting, the header coupled to the upper handling fitting; and a stacking post extending onto the outer surface of the upper handling fitting to overlap a portion of the outer surface, the stacking post coupled to the upper handling fitting and received in overlapping relationship within the recessed portion of the outer surface of the upper handling fitting.

2. The support structure of claim 1, wherein:

the upper surface is defined at least in part by a second recessed portion and a second adjacent unrecessed portion; and the header is received coupled to the upper handling fitting and is received in overlapping relationship with the second recessed portion of the upper surface of the upper handling fitting.

3. The support structure of claim 1, further comprising a lower handling fitting having an outer surface and an upper surface, the outer surface being defined at least in part by a recessed portion and an adjacent unrecessed portion, wherein the stacking post extends to and is coupled to the lower handling fitting, and wherein the stacking post is received in overlapping relationship within the recessed portion of the outer surface of the lower handling fitting.

4. The support structure of claim 1, wherein the recessed portion of the upper handling fitting is a peripheral portion of the outer surface.

5. The support structure of claim 2, wherein the second recessed portion of the upper handling fitting is a peripheral portion of the upper surface.

6. The support structure of claim 1, further comprising at least one gusset coupled to at least one of the upper handling fitting, the header, and the stacking post.

7. The support structure of claim 1, wherein the stacking post comprises:

a length;

a substantially flat cross-sectional shape; and a channel extending along at least part of the length.

8. The support structure of claim 1, wherein the stacking post comprises at least two separate internal compartments.

9. A support structure for a commercial storage and transport container, the storage and transport container comprising a sidewall and a floor, the support structure comprising:

a lower handling fitting having an outer surface and an upper surface, the outer surface being defined at least in part by a recessed portion and an adjacent unrecessed portion, the outer surface facing in a lateral direction to an exterior of the support structure;

a support located in the floor of the container and coupled to the lower handling fitting; and a stacking post extending onto the lower handling fitting to overlap a portion of the outer surface, the stacking post coupled to the lower handling fitting and received in overlapping relationship within the recessed portion of the outer surface of the lower handling fitting.

10. The support structure of claim 9, wherein:

the upper surface is defined at least in part by a second recessed portion and a second adjacent unrecessed portion; and the support is received in overlapping relationship with the second recessed portion of the upper surface of the lower handling fitting.

11. The support structure of claim 9, further comprising a second recess defined within the first recess of the lower handling fitting and within which a protrusion of the stacking post is received.

12. The support structure of claim 9, wherein the stacking post comprises:

a length;

a substantially flat cross-sectional shape; and a channel extending along at least part of the length.

13. The support structure of claim 9, wherein the stacking post comprises at least two separate internal compartments.

* * * * *